US010206505B2

(12) United States Patent
Qualkinbush

(10) Patent No.: US 10,206,505 B2
(45) Date of Patent: Feb. 19, 2019

(54) COMPARTMENTED ASSEMBLY AND METHOD FOR MAKING A COMPARTMENTED ASSEMBLY

(71) Applicant: Ducktronix LLC, Centennial, CO (US)

(72) Inventor: Harold Wayne Qualkinbush, Parker, CO (US)

(73) Assignee: Ducktronix LLC, Centennial, CO (US)

( * ) Notice: Subject to any disclaimer, the term of this patent is extended or adjusted under 35 U.S.C. 154(b) by 106 days.

(21) Appl. No.: 15/406,406

(22) Filed: Jan. 13, 2017

(65) Prior Publication Data

US 2017/0196358 A1 Jul. 13, 2017

Related U.S. Application Data

(60) Provisional application No. 62/278,193, filed on Jan. 13, 2016.

(51) Int. Cl.

| | |
|---|---|
| ***A47B 88/994*** | (2017.01) |
| ***B65D 6/16*** | (2006.01) |
| ***B65D 6/24*** | (2006.01) |
| ***B65D 25/04*** | (2006.01) |
| ***B65D 6/00*** | (2006.01) |

(52) U.S. Cl.

CPC ..... *A47B 88/994* (2017.01); *B65D 9/12* (2013.01); *B65D 9/32* (2013.01); *B65D 11/1866* (2013.01); *B65D 11/20* (2013.01); *B65D 25/04* (2013.01)

(58) Field of Classification Search

CPC ..... A47B 88/994; B65D 9/32; B65D 25/04
USPC ..... 220/533, 552; 217/65, 7
See application file for complete search history.

(56) References Cited

U.S. PATENT DOCUMENTS

| | | | | |
|---|---|---|---|---|
| 2,257,536 A * | 9/1941 | Roycroft | ..... | A47F 10/06 211/126.1 |
| 4,173,287 A * | 11/1979 | Kumakawa | ..... | B65D 9/12 206/600 |
| 4,577,773 A | 3/1986 | Bitel | | |
| 5,105,953 A | 4/1992 | Finnegan | | |

(Continued)

FOREIGN PATENT DOCUMENTS

WO 2006040301 A1 4/2006

OTHER PUBLICATIONS

Induflex, Cast Acrylic Versus Extruded Acrylic, Acrylic Processing, http://www.pmma.dk/Acryl_stobt_kontra_ekstruderet.aspx?Lang=en-GB, 2015, Induflex A/S, Denmark.

(Continued)

*Primary Examiner* — Andrew T Kirsch
*Assistant Examiner* — Don M Anderson
(74) *Attorney, Agent, or Firm* — Marsh Fischmann & Breyfogle LLP; David F. Dockery; Jeremy J. Neilson

(57) ABSTRACT

Compartmented assemblies related to customizable storage compartments. A bottom panel, side panels, and divider panels may be configured in any combination to form a compartmented assembly with a primary compartment comprising at least two sub-compartments. A method of designing and constructing compartmented assemblies is described. A graphical user interface may be used to format a design which may be transmitted to associated machinery for automated cutting of the component panels. Series of notches, tabs, and apertures are used for mating adjacent panels to one another. Adhesive may be inserted into joints for securing the panels.

20 Claims, 12 Drawing Sheets

(56) References Cited

U.S. PATENT DOCUMENTS

| | | | |
|---|---|---|---|
| 5,257,693 | A | 11/1993 | Kwasniak |
| 5,553,710 | A | 9/1996 | Takama |
| 5,664,856 | A | 9/1997 | Pacetti |
| 6,073,794 | A | 6/2000 | Bidot |
| 6,129,433 | A | 10/2000 | Rosenberg et al. |
| 6,695,419 | B2 | 2/2004 | Searer et al. |
| 6,834,924 | B2 | 12/2004 | Hollenstein |
| 6,928,711 | B1 | 8/2005 | Sunka |
| 7,703,866 | B2 | 4/2010 | Benz |
| 7,932,302 | B2 | 4/2011 | Lu et al. |
| 8,397,937 | B2 | 3/2013 | Preschke et al. |
| 8,438,071 | B2 | 5/2013 | Hathaway et al. |
| 8,628,155 | B1 | 1/2014 | Nielson |
| 8,833,881 | B2 | 9/2014 | Manniso et al. |
| 2003/0139840 | A1 | 7/2003 | Magee et al. |
| 2003/0164665 | A1 | 9/2003 | Guay et al. |
| 2003/0184199 | A1 | 10/2003 | Jananji |
| 2006/0124647 | A1 | 6/2006 | Rosenberg et al. |
| 2011/0282476 | A1 | 11/2011 | Hegemier et al. |
| 2012/0059734 | A1 | 3/2012 | Chism et al. |
| 2012/0205335 | A1 | 8/2012 | Abdullahi |
| 2015/0088681 | A1 | 3/2015 | Gladstone et al. |
| 2015/0129443 | A1 | 5/2015 | Young |
| 2015/0158253 | A1 | 6/2015 | Saarela et al. |
| 2015/0238032 | A1 | 8/2015 | Parks |
| 2015/0305501 | A1 | 10/2015 | Brown et al. |

OTHER PUBLICATIONS

Access Plastics, Difference Between CAST Acrylic Sheet and Extruded Acrylic Sheets, http://www.accessplastics.com/cast-vsextruded-acrylic/, 2015, Access Plastics, Ashboume Co Meath, Ireland.

Dymax, Ultra Light-Weld 3030, Ultra-Fast Cure, Clear, LED-Curable Plastic Bonder, 3030 Product Data Sheet, May 9, 2012, Dymax Corporation, Torrington, CT.

Dymax, Ultra Light-Weld 3069, Flexible Laminating and Bonding Material, 3069 Product Data Sheet, May 9, 2012, Dymax Corporation, Torrington, CT.

Dymax, Ultra Light-Weld 3099, Adhesive for Bonding Acrylic, 3099 Product Data Sheet, May 9, 2012, Dymax Corporation, Torrington, CT.

Velankar, Sachin et al., High-Performance UV-Curable Urethane Acrylates via Deblocking Chemistry, Journal of Applied Polymer Science, Nov. 28, 1996, pp. 1361-1376, vol. 62, Issue 9, John Wiley & Sons, Inc., Unites States.

Arceneaux, Jo Ann et al., UV&EB Chemistry and Technology, RadTech Printer's Guide, 2007, RadTech International North America, Bethesda, MD.

* cited by examiner

COMPARTMENTED ASSEMBLY AND METHOD FOR MAKING A COMPARTMENTED ASSEMBLY

RELATED APPLICATIONS

This application claims the benefit of U.S. Provisional Patent Application No. 62/278,193 filed Jan. 13, 2016, entitled "COMPARTMENTED ASSEMBLY AND METHOD FOR MAKING A COMPARTMENTED ASSEMBLY," which is incorporated herein by reference in its entirety.

FIELD

This disclosure relates to the field of compartmented assemblies such as drawer organizers to facilitate the organized placement of items within the assembly.

BACKGROUND

Consumers and professionals frequently struggle with storing tools, utensils, accessories, or other items in an organized manner. Frequently, items are tossed into a drawer, for example, in a disorderly fashion without a coherent organizational arrangement. Without proper organization, many items are misplaced, concealed, or otherwise difficult to locate when needed.

Solutions have been offered for improving the organization of items within storage enclosures. For example, plastic or wood eating utensil drawer organizers are quite common. Such trays contain compartments sized to accept forks, spoons, knives, etc. The overall size and shape of such common utensils are generally uniform such that the compartments for each respective type of utensil may be slightly oversized such that a range of shapes and sizes may fit within the compartments. However, oddly-shaped or oversized utensils may not fit within these generic, mass-produced trays.

Furthermore, the need for compartmented storage solutions goes beyond utensils in a kitchen drawer. For instance, machine shops, automotive repair companies, or appliance repairmen may frequently carry a significant inventory of small parts such as screws and bolts of various sizes. Locating a needed part quickly may improve efficiency and thereby increase productivity. In this regard, a particular shop or other user may desire to store dozens of different sizes of a similar part (e.g., screws), arranged by size. The quantity of each part desired to be stored in inventory may vary by the volume of each size that is typically needed, thus affecting the compartment size needed for each type of screw.

Additionally, the need for organization is apparent in many other settings, for instance, in an operating room where time spent searching for tools and implants is not only costly in the sense of the medical staff's time, but may even be detrimental to the health of a patient. Solutions may exist for storing tools commonly used in routine procedures, but special applications may require a set of tools that are infrequently used in a given combination to be accessible and organized together in a specific arrangement during a procedure. A compartmented storage solution may not exist for such a specialized or unique set of tools.

Therefore, a need exists for customizable storage solutions designed to accommodate individual storage requirements of a variety of users, with a variety of stored items, and in a seemingly infinite range of possible arrangements.

SUMMARY

The present disclosure relates generally to compartmented assemblies and methods of production therefor. For example, a compartmented assembly may comprise a bottom panel, a plurality of side panels, and at least one divider panel. As such, in at least some embodiments disclosed herein, a compartmented assembly is described where a series of notches, tabs, and apertures may be used to interlock the various panels together. Additionally, the present disclosure may include embodiments that include the use of an adhesive for securing the notches, tabs, and apertures to retain the panels in the configuration of a compartmented assembly. Accordingly, the present disclosure may find application in the field of storing and organizing items.

The disclosed embodiments provide a number of benefits over the prior art. For instance, a user can design a compartmented assembly with a plurality of compartments or sub-compartments which are sized to accommodate the user's items. The user may specify the overall dimensions of the compartmented assembly, the dimensions of each sub-compartment, the orientation and arrangement of each sub-compartment, and the thickness of the material used to construct the compartmented assembly, among other specifications.

Accordingly, a first embodiment of a compartmented assembly includes a bottom panel comprised of a bottom panel floor bounded by at least three bottom panel edges, the bottom panel edges comprised of a plurality of bottom panel edge attachment notches disposed along each of the bottom panel edges, the bottom panel edge attachment notches defining bottom panel edge attachment tabs therebetween. The bottom panel floor may include a first plurality of bottom panel floor attachment apertures disposed in the bottom panel floor.

The compartmented assembly also includes at least three side panels, each of the at least three side panels being comprised of a side panel wall bounded by a side panel top edge, a side panel bottom edge and two side panel end edges. Each side panel bottom edge comprises side panel bottom edge attachment notches defining side panel bottom edge attachment tabs therebetween. At least two of the side panels may comprise at least a side panel side edge attachment aperture disposed in the side panel wall.

The compartmented assembly further includes at least a first divider panel comprising a divider panel wall bounded by a divider panel top edge, a divider panel bottom edge and two divider panel side edges. The divider panel bottom edge may comprise divider panel bottom edge attachment notches defining at least one divider panel bottom edge attachment tab therebetween. The divider panel side edges may comprise at least two divider panel side edge attachment notches defining at least one divider panel side edge attachment tab therebetween. The at least three side panels are may be attached to the bottom panel by mating the side panel bottom edge attachment tabs to the bottom panel edge attachment notches, such that the at least three side panels are disposed substantially orthogonally from the bottom panel floor to define a primary compartment bounded by the bottom panel floor and the at least three side panel walls. The at least first divider panel is attached to the bottom panel by mating the divider panel bottom edge attachment tabs to the bottom panel attachment aperture(s), and by mating the at least one divider panel side edge attachment tab to the first divider panel side edge attachment tab aperture, wherein the divider panel divides the primary compartment into at least first and second sub-compartments.

In another embodiment of a compartmented assembly, the bottom panel comprises at least a fourth bottom panel edge and the compartmented assembly comprises at least a fourth side panel that is attached to the bottom panel by mating the fourth side panel bottom edge attachment tabs to the bottom panel edge attachment notches such that the at least four side panels are disposed substantially orthogonally from the bottom panel to define a primary compartment bounded by the bottom panel and the at least four side panels. The at least four side panels may define a substantially rectangular primary compartment.

In another aspect of a compartmented assembly, the bottom panel floor comprises at least a second plurality of divider panel bottom edge attachment tab apertures disposed in a substantially linear arrangement in the bottom panel floor and the compartmented assembly comprises at least a second divider panel that is attached to the bottom panel by mating the second divider panel bottom edge attachment tabs to the second plurality of divider panel bottom edge attachment apertures disposed in the bottom panel floor to divide a sub-compartment into at least two smaller sub-compartments. The second divider panel may or may not be disposed substantially parallel to the first divider panel. Additionally, the second divider compartment may or may not be disposed substantially orthogonal to the first divider panel.

In another aspect of a compartmented assembly, the side panel end edges comprise at least one side panel end edge attachment tab or at least one side panel end edge attachment notch that is mated to a corresponding side panel end edge attachment tab or side panel end edge attachment notch that is disposed in and adjacent side panel.

In yet another aspect, the bottom panel, side panels and divider panel(s) are fabricated from a substantially rigid material. The substantially rigid material may or may not be translucent or transparent. The bottom panel, side panels, and divider panel(s) may be fabricated from acrylic, and perhaps, may be fabricated from cast acrylic.

In another aspect, the bottom panel, side panels and divider panel(s) may have a thickness of at least about 0.106 inches and not greater than about 0.275 inches.

In another aspect, the side panels and the divider panel(s) are secured to the bottom panel using an adhesive. The adhesive may be a radiation curable adhesive, for example, a UV curable adhesive. Additionally or alternatively, the adhesive may be a clear acrylic adhesive, for example, an acrylated urethane adhesive.

In another aspect of a compartmented assembly, the portions of the bottom panel floor that are circumscribed by the side panels and divider panel(s) are free of attachment tab apertures.

Another embodiment of the present disclosure includes a method for the manufacture of a compartmented assembly. A first aspect involves cutting a bottom panel from a sheet of material and further cutting bottom panel edge attachment notches into at least three bottom panel edges, the bottom panel edge attachment notches defining bottom panel edge attachment tabs therebetween. A bottom panel floor is disposed between the at least three bottom panel edges. The cutting a bottom panel aspect may also comprise cutting at least a first plurality of divider panel attachment tab apertures in a substantially linear arrangement in the bottom panel floor.

In another aspect, the method may include cutting at least three side panels each comprising a side panel wall from a sheet of material, the cutting at least three side panels comprising cutting a substantially smooth side panel top edge and cutting side panel bottom edge attachment notches into each side panel bottom edge. The side panel bottom edge attachment notches define side panel bottom edge attachment tabs therebetween. Further, the method may include cutting at least a first divider panel side edge attachment tab aperture into at least two of the side panel walls.

Another aspect includes cutting at least a first divider panel from a sheet of material, the cutting at least first divider panel comprising cutting a substantially smooth divider panel top edge and cutting divider panel bottom edge attachment notches into a divider panel bottom edge. The divider panel bottom edge attachment notches define divider panel bottom edge attachment tabs therebetween. The method may further include cutting divider panel side edge attachment notches into divider panel side edges, the divider panel side edge attachment notches defining divider panel side edge attachment tabs therebetween.

In yet another aspect, the method includes attaching the at least three side panels to the bottom panel by mating the side panel bottom edge attachment tabs to the bottom panel edge attachment notches such that the at least three side panels are disposed substantially orthogonally from the bottom panel to define a primary compartment bounded by the bottom panel floor and the at least three side panel walls. The method may include applying an adhesive to a juncture between the side panel bottom edges and the bottom panel edges.

In another aspect, the method may include attaching the at least first divider panel to the bottom panel floor by mating the divider panel bottom edge attachment tabs to the at least a first plurality of divider panel attachment tab apertures disposed in the bottom panel floor to divide the primary compartment into at least first and second sub-compartments. The attaching the at least first divider panel may include applying an adhesive to a juncture between the divider panel bottom edge and the bottom panel floor.

In an aspect, the cutting steps may include cutting with a laser.

In another aspect, the adhesive may comprise a radiation curable adhesive, for example, a UV curable adhesive. The UV curable adhesive may comprise an acrylated urethane adhesive.

Another aspect of a method for the manufacture of a compartmented assembly may include the step of UV curing the adhesive.

In an aspect, the bottom panel, the at least three side panels, and the at least first divider panel may be cut from the same sheet of material.

In another embodiment of a method for the manufacture of a compartmented assembly, the method may comprise providing, over a network, an interactive template that enables a user to graphically design a compartmented assembly comprising a bottom panel and at least three side panels that define a primary compartment and at least one divider panel bisecting the primary compartment to form two sub-compartments. The interactive template may provide the ability of the user to graphically input specifications for the compartmented assembly, including at least a size and shape of the base panel and the placement of the at least one divider panel within the primary compartment.

In further aspects, the embodiment may include receiving, over the network, the specifications from the user; inputting the specifications to a digitally controlled cutting device; placing a sheet of material into the digitally controlled cutting device; cutting at least the bottom panel, the at least three side panels and the at least first divider panel in accordance with the specifications; removing the bottom panel, the at least three side panels and the at least first divider panel from the digitally controlled cutting device; and assembling the compartmented assembly.

In one aspect, the digitally controlled cutting device may be a laser cutter.

In another aspect, the sheet of material may be an acrylic sheet, for example, cast acrylic. The sheet of material may have a thickness of at least about 0.106 inches and not greater than about 0.275 inches.

In another aspect, the step of cutting a bottom panel comprises cutting bottom panel edge attachment tabs into at least three bottom panel edges, the bottom panel edge attachment tabs defining bottom panel edge attachment notches therebetween. A bottom panel floor is disposed between the at least three bottom panel edges, the cutting a bottom panel also comprising cutting at least a first plurality of divider panel attachment tab apertures in a substantially linear arrangement in the bottom panel floor.

In another aspect, the step of cutting at least three side panels from the sheet of material comprises cutting a substantially smooth side panel top edge and cutting side panel bottom edge attachment tabs into each side panel bottom edge, the side panel bottom edge attachment tabs defining side panel bottom edge attachment notches therebetween.

In yet another aspect, the step of cutting at least a first divider panel comprises cutting a substantially smooth divider panel top edge and cutting divider panel bottom edge attachment tabs into a divider panel bottom edge, the divider panel bottom edge attachment tabs defining divider panel bottom edge attachment notches therebetween.

In an aspect, the assembling may comprise attaching the side panels and the divider panel(s) to the bottom panel with an adhesive. The adhesive may be a UV curable adhesive, such as an acrylated urethane adhesive.

In yet another aspect, the assembling may further comprise the step of UV curing the adhesive.

In another aspect of the present invention, the compartmented assembly, as a whole unit or in parts, may be destaticized. In one embodiment, the compartmented assembly may be passed through a neutral or balanced flow of ionized air. For example, the compartmented assembly may be disposed in front of an ionizing blower such as Dr. Schneider SL-001 Desktop Ionizing Blower. Preferably, a blower used in such an application would produce at least 10 CFM of ionized air, for example at least 45 CFM, and more preferably, at least 100 CFM. As the volume or richness of ionized air is increased, the length of time the compartmented assembly is disposed in the flow of ionized air may be reduced. In one example, the compartmented assembly may disposed in the flow of ionized air for at least 10 seconds. It may be desirable to destaticize the compartmented assembly before assembling the panels, immediately after assembling the panels, before a first application of adhesive, before applying each subsequent application of adhesive, after cleaning the completed compartmented assembly, and before packaging. The destaticizing may help prevent problems that can arise from the buildup of static electricity on the compartmented assembly. For example, static may attract droplets of adhesive to regions of the compartmented assembly at which it is undesirable to apply adhesive.

BRIEF DESCRIPTION OF THE DRAWINGS

FIG. 18 illustrates a cut file that arranges the various components of a compartmented assembly on a material sheet.

FIG. 19 illustrates an embodiment of intersecting divider panels for use in a compartmented assembly.

DETAILED DESCRIPTION

Figure 1:
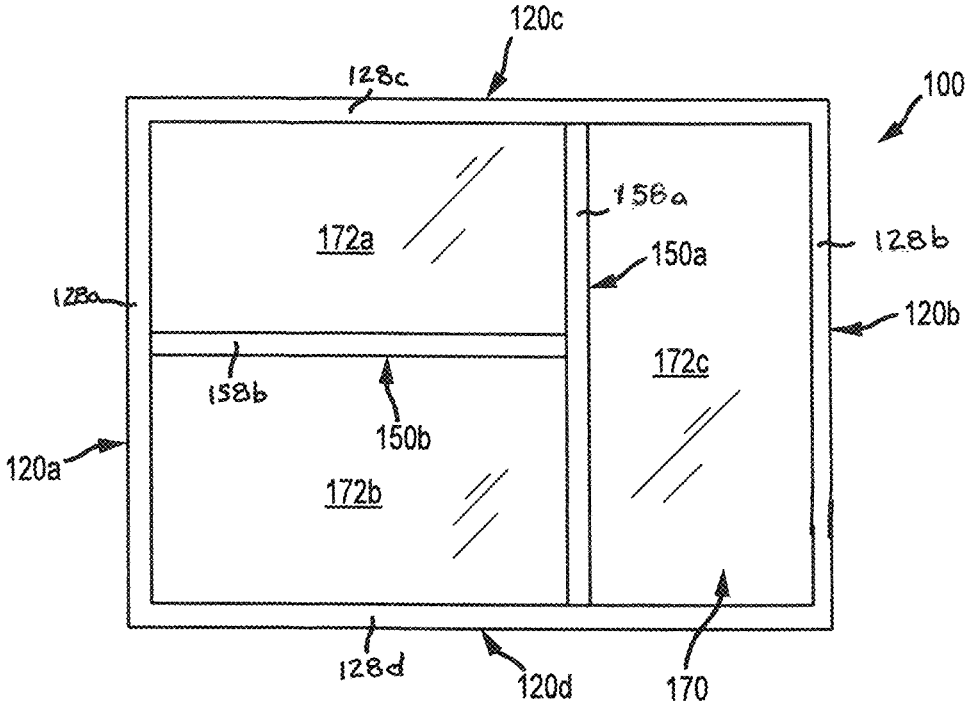
FIG. 1 illustrates a top view of a compartmented assembly according to an embodiment.
Figure 2:
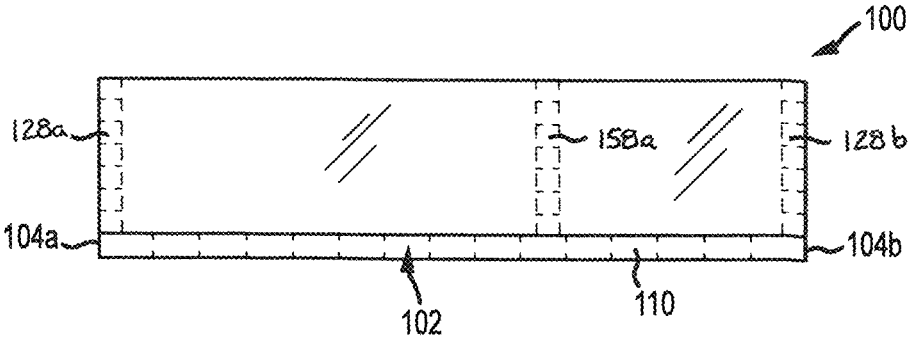
FIG. 2 illustrates a side view of the compartmented assembly illustrated in FIG. 1.

Referring to FIGS. 1 and 2, a compartmented assembly 100 is illustrated. FIG. 1 illustrates a top view of the compartmented assembly 100 and FIG. 2 illustrates a side view of the compartmented assembly 100. As illustrated in FIGS. 1 and 2, the components of the compartmented assembly are each transparent. The compartmented assembly 100 includes a bottom panel 102 and four side panels 120*a*120*b*/120*c*/120*d*. The four side panels are each attached to the bottom panel 102 and are disposed in a substantially orthogonal orientation from a bottom panel floor 110 to define a primary compartment 170 that is bounded by the bottom panel floor 110 and four side panel walls 128*a*, 128*b*, 128*c* and 128*d*. Although illustrated as including four side panels to form a substantially rectangular compartmented assembly 100, it will be appreciated that the compartmented assemblies disclosed herein may include as few as three side panels, i.e., to form a triangular primary compartment. The compartmented assemblies may also include more than four side panels, such as to form a hexagonally-shaped primary compartment.

Thus, the bottom panel floor 110 and the four side panel walls 128*a*, 128*b*, 128*c* and 128*d* define and bound the primary compartment 170. The compartmented assembly 100 illustrated in FIGS. 1 and 2 also includes two divider panels 150*a* and 150*b* that are disposed within the primary compartment 170 such that divider panel walls 158*a* and 158*b* divide the primary compartment 170 into three sub-compartments 172*a*, 172*b* and 172*c*. The divider panel 150*a* is attached to the side panels 120*c* and 120*d* and extends across the bottom panel floor 110 from side panel wall 128*c* to side panel wall 128*d*. Thus, the divider panel 150*a* forms sub-compartment 172*c*. The compartmented assembly further comprises a second divider panel 150*b* that extends from (first) divider panel wall 158*a* to side panel wall 128*a* to form sub-compartments 172*a* and 172*b*. It should be appreciated that any number of divider panels may be disposed within the primary compartment, e.g., to form any number of sub-compartments.

Figure 3:
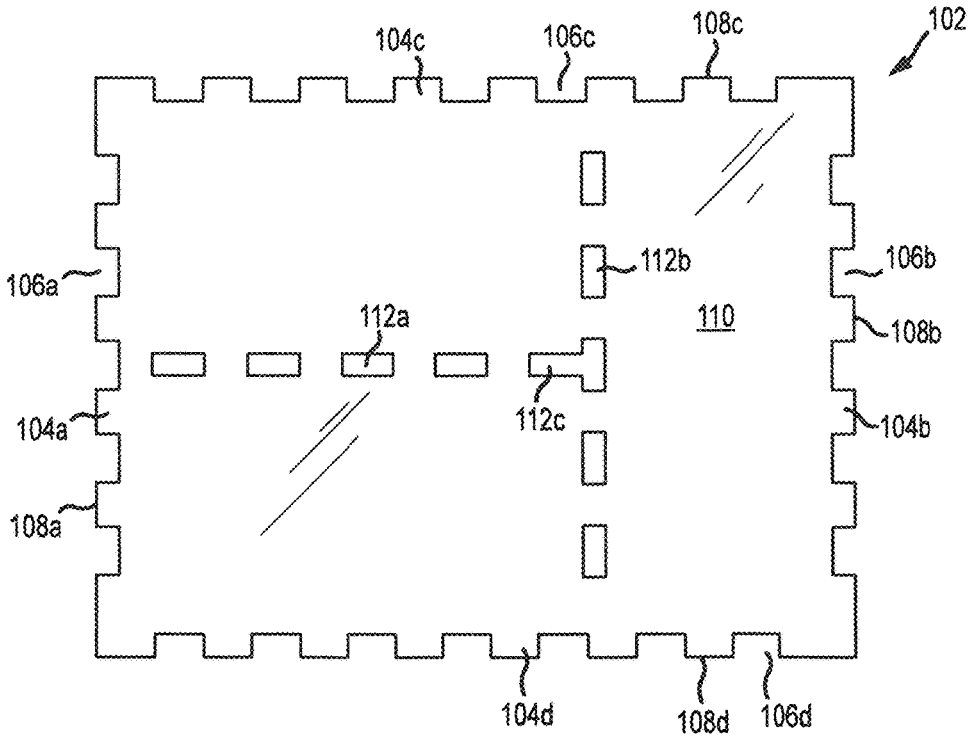
FIG. 3 illustrates a bottom panel of the compartmented assembly illustrated in FIG. 1.

The individual components and a method for assembling the components into a compartmented assembly will now be described with respect to FIGS. 3-8. FIG. 3 illustrates a top view of the bottom panel 102. The bottom panel 102 comprises a bottom panel floor 110 that is bounded by four bottom panel edges, e.g., by edges 104*a*/104*b*/104*c*/104*d*. The bottom panel edges each include a plurality of bottom panel edge attachment notches, e.g., notches 106*a*/106*b*/106*c*/106*d*, which extend along the length of each of the bottom panel edges. The bottom panel edge attachment notches define bottom panel edge attachment tabs, e.g., attachment tabs 108*a*/108*b*/108*c*/108*d* therebetween. As is discussed in more detail below, the bottom panel edge attachment notches and attachment tabs are configured (e.g., sized and shaped) to operatively mate with similar notches and tabs disposed on a bottom edge of the side panels during construction of the compartmented assembly 100.

The bottom panel 102 also includes bottom panel floor attachment apertures (e.g., apertures 112*a*/112*b*/112*c*) that are disposed in the bottom panel floor 110. The bottom panel floor attachment apertures extend linearly across at least a portion of the bottom panel floor 110 and are configured (e.g., sized and shaped) to receive and operatively engage attachment tabs that are disposed on a bottom edge of the divider panels, as is discussed in more detail below. The bottom panel floor attachment apertures may be of any useful shape, and as is illustrated in FIG. 3, at least a portion of the attachment apertures may be substantially rectangular in shape (e.g., apertures 112*a* and 112*b*). Some attachment apertures in the bottom panel floor 110 may have a "T" configuration, as is illustrated by attachment aperture 112*c*, such as to accommodate first and second divider panels that abut in an orthogonal manner, as is illustrated in FIG. 1. Additionally, some attachment apertures may have a "+" configuration to accommodate intersecting or opposed divider panels, e.g. to form four or more sub-compartments. Although described herein as apertures, these features may extend all the way through the bottom panel floor 110 or may extend only partially through the bottom panel floor.

Figure 4:
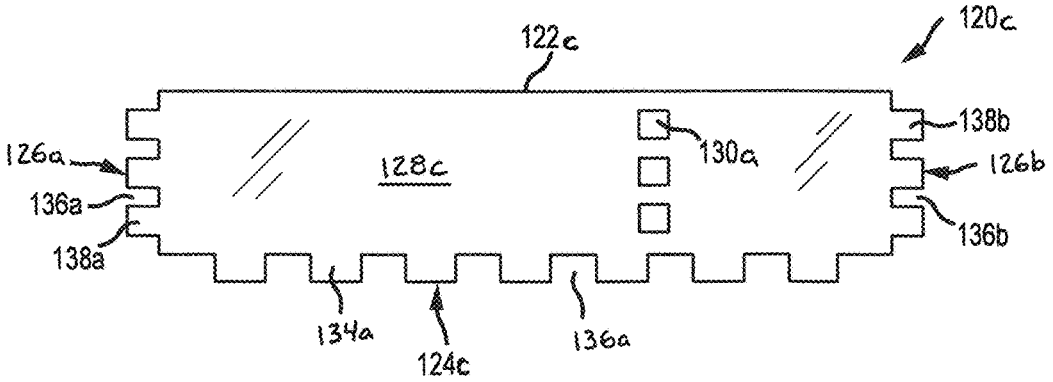
FIG. 4 illustrates a side panel of the compartmented assembly illustrated in FIG. 1.

FIG. 4 illustrates the side panel 120*c* (FIG. 1). It will be appreciated that in the compartmented assembly 100 illustrated in FIGS. 1-2, the side panels 120*c* and 120*d* will have a substantially identical configuration. For simplicity, only side panel 120*c* will be described, it being understood that side panel 120*d* has a substantially identical configuration as side panel 120*c*.

The side panel 120*c* comprises a side panel wall 128*c* that is bounded by a side panel top edge 122*c*, a side panel bottom edge 124*c* and by side panel end edges 126*a*/126*b*. The side panel top edge 122*c*, which may be disposed in the top plane of the compartmented assembly 100, is substantially smooth in this illustration, e.g., for aesthetic and tactile purposes. However, it should be appreciated that the side panel top edge may be notched or may include an otherwise non-linear feature, e.g., to accommodate a portion of an item that a user may desire overhangs the side panel. The side panel bottom edge 124*c* comprises a plurality of side panel bottom edge attachment notches (e.g., notch 136*a*). The bottom edge attachment notches define side panel bottom edge attachment tabs (e.g., attachment tab 134*a*) therebetween. On opposite sides of the side panel 120*c* are the two side panel end edges 126*a*/126*b*. The side panel end edges include side panel end edge attachment notches (e.g., attachment notches 136*a* and 136*b*). The end edge attachment notches define side panel end edge attachment tabs (e.g., attachment tabs 138*a*/138*b*) disposed therebetween. As can be appreciated from FIGS. 1 and 2, the side panel end edge attachment notches and side panel end edge attachment tabs are configured (e.g., sized and shaped) to operatively mate with the side panel end edge attachment notches and side panel end edge attachment tabs of an adjacent side panel during construction. Further, the side panel bottom edge attachment notches and side panel bottom edge attachment tabs are configured (e.g., sized and shaped) to operatively mate with the bottom panel edge attachment notches and bottom panel edge attachment tabs, e.g., as illustrated in FIG. 3. Also, the side panel wall 128*c* includes a plurality of side panel wall attachment apertures (e.g., aperture 130*a*) disposed in (e.g., through) the side panel wall 128*c*.

Figure 5:
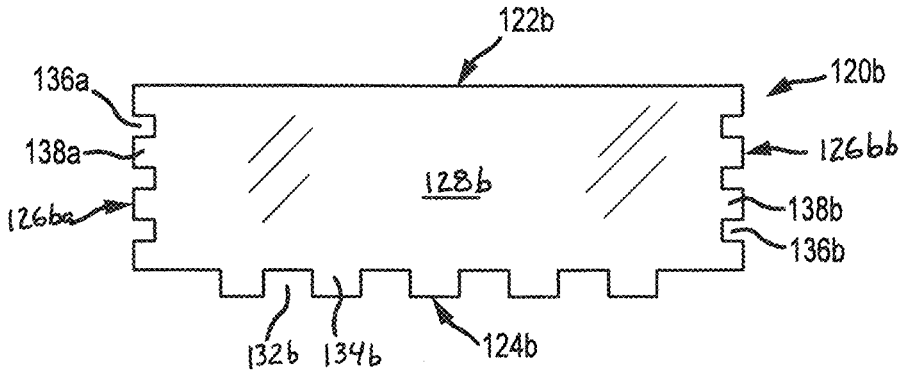
FIG. 5 illustrates another side panel of the compartmented assembly illustrated in FIG. 1.
Figure 6:
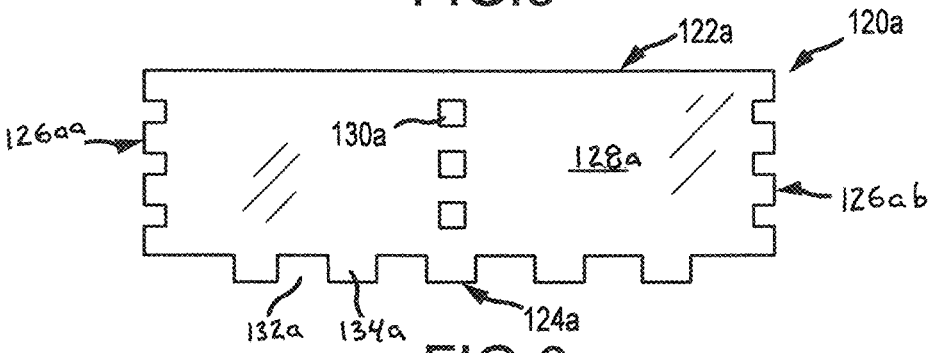
FIG. 6 illustrates another side panel of the compartmented assembly illustrated in FIG. 1.

Referring to FIGS. 5 and 6, side panels 120*a* and 120*b* (FIG. 1) are illustrated. Specifically, FIG. 5 illustrates side panel 120*b* and FIG. 6 illustrates side panel 120*a*. Side panels 120*b* and 120*a* are substantially identical, with the exception of the side panel wall attachment apertures (e.g., aperture 130*a*) in side panel wall 128*a*.

Each of the side panels 120*a* and 120*b* comprises a top edge (122*a* and 122*b*), a bottom edge (124*a* and 124*b*) and two side panel end edges (126*aa*/126*ab* and 126*ba*/126*bb*) that bound and define a side panel wall (128*a* and 128*b*). As with side panels 120*c* and 120*d*, the side panel top edges 122*a* and 122*b* may be relatively smooth, e.g., devoid of notches and tabs, or may include other features as is described above. The side panel bottom edges 124*a* and 124*b* comprise side panel bottom edge attachment notches (e.g., 132*a* and 132*b*) that define side panel bottom edge attachment tabs 134*a*/134*b* therebetween. The notches and tabs are configured (e.g., sized and shaped) to operatively mate with the bottom panel edge notches and tabs, e.g., as illustrated in FIG. 3.

As is noted above, the side panel 120*a* includes a plurality of side panel wall attachment apertures, e.g., aperture 130*a*. These attachment apertures are configured (e.g., sized and shaped) to mate with divider panel side edge attachment tabs that are described below with respect to FIG. 7. Although illustrated as comprising a plurality of side panel wall attachment apertures, it will be appreciated that the side panel may include only a single side panel wall attachment aperture to facilitate attachment of a divider panel to a side panel.

Figure 7:
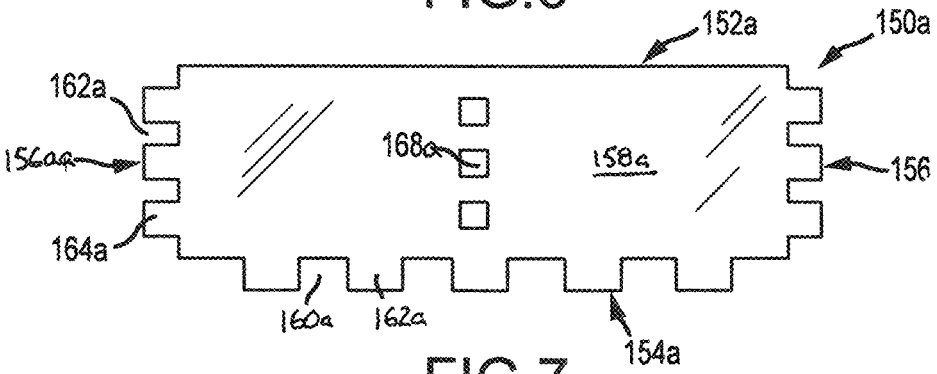
FIG. 7 illustrates a divider panel of the compartmented assembly illustrated in FIG. 1.
Figure 8:
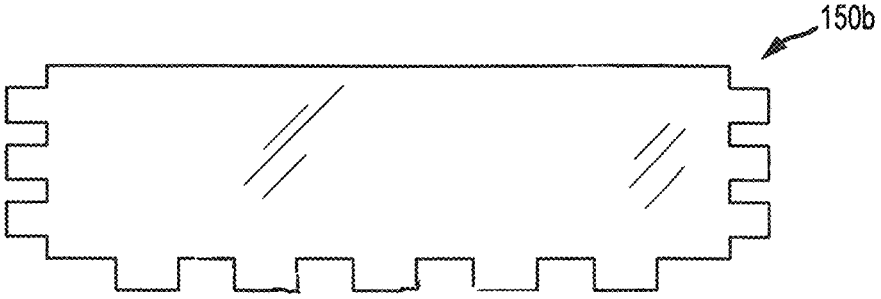
FIG. 8 illustrates another divider panel of the compartmented assembly illustrated in FIG. 1.

FIG. 7 illustrates the first divider panel 150*a* of the compartmented assembly 100. The divider panel 150*a* comprises a divider panel wall 158*a* bounded by a divider panel top edge 152*a*, a divider panel bottom edge 154*a* and divider panel side edges 156*aa*/156*ab*. The divider panel bottom edge 154*a* includes divider panel bottom edge attachment notches (e.g., notch 160*a*), the divider panel bottom edge attachment notches defining divider panel bottom edge attachment tabs 160*a* therebetween. Further, the divider panel side edges 156*a* comprise divider panel side edge attachment notches 162*a* defining divider panel side edge attachment tabs 162*a* therebetween. The first divider panel 150*a* also includes divider panel wall attachment apertures (e.g., aperture 168*a*) disposed in a substantially linear arrangement, e.g., vertically disposed, in the divider panel wall 158*a*. FIG. 8 illustrates a second divider panel 150*b* that is substantially identical in configuration and shape to the first divider panel 150*a*. However, in the embodiment illustrated in FIGS. 1-8, the divider panel 150*b* does not include the divider panel side edge attachment apertures that are disposed in the divider panel 150*a*.

Although illustrated in FIGS. 3-8 as including a plurality of notches and tabs in the side edges and bottom edges of the components, it is also possible that sufficient strength and integrity may be obtained utilizing a single tab (e.g., surrounded by two "notches" that extend to the end of the panel edge) and/or a single notch (e.g., substantially centered on the panel edge) to obtain a sufficiently robust coupling between the components, particularly when the components are also bonded with an adhesive. See the embodiment illustrated in FIG. 18, for example.

The components of the compartmented assembly described above may each be fabricated from a substantially rigid material. For example, the components of the compartmented assembly may be fabricated from wood, plastic, etc. Further, the substantially rigid material may be translucent or transparent, and in one particular embodiment the components are fabricated from rigid material which is substantially transparent. In another particular embodiment, the components including the bottom panel, side panels and divider panels are fabricated from acrylic (e.g., poly(methyl methacrylate)) and in particular may be fabricated from cast acrylic. Cast acrylic is particularly useful when the components are fabricated by cutting the components from a sheet of material using a laser.

Irrespective of the material utilized to fabricate the components of the compartmented assembly, the material sheet may have a thickness of at least about 0.106 inches, and may have a thickness of not greater than about 0.275 inches. That is, the thickness of the components may be at least about 0.106 inches and not greater than about 0.275 inches. Although the compartmented assemblies disclosed herein are not limited to such thicknesses, when the compartmented assemblies are fabricated from acrylic and have a thickness of less than about 0.106 inches, the strength of the compartmented assembly may be compromised, and when the thickness is greater than about 0.275 inches the ability to cleanly cut the acrylic sheet may be diminished.

In order to securely attach the various components to one another in the desired configuration (e.g., along the edges thereof), it may be desirable to also use an adhesive, e.g. along the joints where the bottom and side edges of the components are mated (e.g., tab in notch). In one particular embodiment, the adhesive is a radiation curable adhesive, for example an ultraviolet (UV) polymer adhesive, i.e., one that is curable using ultraviolet radiation. Examples of UV curable adhesives include those classified as acrylated urethanes. To maintain the aesthetic appearance (e.g., the substantially transparent nature) of the compartmented assembly, the adhesive may be substantially clear (e.g., transparent) and may have a refractive index that is close to the refractive index of the assembled components, e.g., close to the refractive index of the acrylic. For example, acrylic typically has a refractive index of about 1.489 to about 1.492. The adhesive may therefore have a refractive index (i.e., in the cured state) of at least about 1.400, such as at least about 1.450, and not greater than about 1.600, such as not greater than about 1.550. Stated another way, the refractive index of the cured adhesive may be within about ±10% of the refractive index of the assembled components, such as within about ±8% of the refractive index of the assembled components, such as within about ±5% of the refractive index of the assembled components.

Among other useful characteristics of the selected adhesive is that the adhesive be strong and durable in both cold and warm temperatures. Thus, the adhesive may be selected to maintain its adhesive properties over a wide range of temperatures, such as from about −65° F. to about 300° F., for example. In this manner, a compartmented assembly may be used in freezer and refrigerator applications, as well as outdoors. Examples of useful UV curable adhesives include DYMAX Ultra Light-Weld 3099, DYMAX Ultra Light-Weld 3069 and DYMAX Ultra Light-Weld 3050, each available from Dymax Corp., Torrington, Conn., USA. When the components are fabricated from a substantially transparent acrylic material, it has been found that DYMAX Ultra Light-Weld 3099 is particularly useful as a UV curable adhesive in order to maintain the aesthetic qualities of the compartmented assembly and to penetrate the small spaces between and along the joints of the mated components. Properties of this exemplary adhesive are listed in Table I:

TABLE I

CURED PROPERTIES OF DYMAX ULTRA LIGHT-WELD 3099

| Property | Value | Test Method |
|---|---|---|
| Durometer Hardness | D75 | ASTM D2240 |
| Tensile at Break, MPa [psi] | 19 [2,800] | ASTM D638 |
| Elongation at Break, % | 170 | ASTM D638 |
| Modulus of Elasticity, MPa [psi] | 400 [58,000] | ASTM D638 |
| Refractive Index (20° C.) | 1.51 | ASTM D542 |
| Boiling Water Absorption, % (2 hr) | 6.2 | ASTM D570 |
| Water Absorption, % (25° C., 24 hr) | 8.4 | ASTM D570 |
| Linear Shrinkage, % | 0.4 | ASTM D2566 |
| Glass Transition Tg, ° C. | 85 | Dymax Std Testing Method |

As will be discussed in more detail below, the compartmented assembly may be assembled using more than one adhesive, e.g., where the adhesives have a different viscosity.

The present disclosure is also directed to a method for the manufacture of a compartmented assembly. Broadly speaking, the method may include cutting the individual components (e.g., the panels) of a compartmented assembly from one or more material sheets, wherein at least some edges of the components include a notch and tab configuration, assembling the individual components into the desired arrangement, and applying an adhesive along the mated joints to secure the components to one another. Notably, the adhesive may also be applied before mating the panels together. As is discussed above, the material sheets may be acrylic (e.g., cast acrylic) sheets, and the adhesive may be a radiation curable adhesive, such as the UV curable adhesives discussed above. The adhesive may be applied in one or more steps, e.g., with a curing step between multiple applications of one or more types of adhesive.

In one embodiment, the method for manufacturing a compartmented assembly may include cutting a bottom panel from a sheet of material, where the cutting includes cutting bottom panel edge attachment notches into at least three bottom panel edges, where the bottom panel edge attachment notches defining bottom panel edge attachment tabs therebetween. A bottom panel floor is defined by and disposed within the at least three bottom panel edges. In certain embodiments, the cutting of the bottom panel may also include cutting at least a first plurality of bottom panel floor attachment apertures in a substantially linear arrangement in the bottom panel floor, e.g., as is illustrated in FIG. 3.

The method may also include cutting at least three side panels for attachment to the bottom panel, such as four side panels (e.g., to form a rectangular compartmented assembly. Each side panel includes a side panel wall that is defined by a substantially smooth side panel top edge, a side panel bottom edge and two side panel side edges. Attachment notches may be cut into each of the side panel bottom edge and/or side panel side edges, where the attachment notches define an attachment tab(s) therebetween. In certain embodiments, the method may also include cutting at least a first divider panel side edge attachment tab aperture into at least two of the side panel walls, e.g., to operatively mate with a divider panel side edge attachment tab during assembly.

The method may also include cutting at least a first divider panel from a sheet of material. The cutting of the first divider panel may include cutting a substantially smooth divider panel top edge and cutting a divider panel bottom edge including attachment notches, where the divider panel bottom edge attachment notches define divider panel bottom edge attachment tabs therebetween. The method may also include cutting divider panel side edge attachment notches into the divider panel side edges, the divider panel side edge attachment notches defining divider panel side edge attachment tabs therebetween. One or more divider panel wall attachment apertures may also be formed in the divider panel wall(s), as may be necessary for a given compartmented assembly design.

Any means of cutting the foregoing components (e.g., floor panel, side panels and divider panel(s)) may be employed, and the preferred method may depend upon the material from which the components are formed. Such cutting techniques may include mechanical cutting with a precision saw, water-jet cutting, gas torch, plasma torch, etc. The cutting device may advantageously be numerically controlled. In one particular embodiment, laser cutting is utilized and the laser is numerically controlled, e.g., by a digital computing device. Lasers may advantageously cut the material sheet at very high speeds with very high accuracy (e.g., tolerance), which is highly desirable particularly with respect to the formation of notches and tabs on the edges of the components. Additionally, lasers may be controlled to leave an aesthetically desirable polished edge on many plastics and acrylic materials.

Although the present disclosure is not limited to compartmented assemblies constructed from acrylic, nor to using lasers to cut the components, for simplicity the remaining description will describe the use of transparent acrylic material sheets and a laser to cut the components from the acrylic sheets.

To construct the compartmented assembly, the side panels may be attached to the bottom panel by mating the side panel bottom edge attachment tabs to the bottom panel edge attachment notches such that the side panels are disposed substantially orthogonally from the bottom panel to define a primary compartment bounded by the bottom panel floor and the side panel walls. Likewise, the one or more divider panels may be attached to the bottom panel by mating (e.g., inserting) the divider panel bottom edge attachment tabs into the bottom panel floor attachment apertures in the bottom panel floor. The divider panel may also be attached to two of the side panels by mating the divider panel side edge attachment tabs to the side panel wall attachment apertures in the side walls. In this way, the primary compartment is divided into at least first and second sub-compartments.

After so initially mating the components in this manner, an adhesive may be applied to the joints between the side panel bottom edges and the bottom panel edges to secure the side panels to the bottom panel. At this point it should be noted that certain material sheets such as acrylic sheets are provided by the manufacturer with protective masking on the major surfaces of the sheet, such as paper masking that is lightly adhered to the sheet. According to certain embodiments, the protective masking is left on the surfaces of the material sheet during laser cutting. After laser cutting, the protective masking may be removed from the component walls that will be disposed on the interior of the compartmented assembly, e.g., within the primary compartment. Thus, the bottom panel and the side panels may have the masking removed from one side of the component, whereas the interior divider panel(s) may have the masking removed from both sides of the divider panel(s). Removal of paper masking may be facilitated by gently heating the components to soften the underlying adhesive. Further, the divider panel may be attached to the bottom panel floor by mating the divider panel bottom edge attachment tabs to the bottom panel floor attachment apertures. In this way, the primary compartment is divided into at least first and second sub-compartments. The divider panel may also be attached to one or more (e.g., two) of the side panels by mating the divider panel side tabs to the apertures in the side walls and applying an adhesive. As is discussed above, the adhesive may be a UV curable adhesive, in which case the assembly may then be subjected to UV radiation to cure the adhesive.

Accordingly, a first UV adhesive may be applied to the interior portion of the joints (i.e., applied from within the primary compartment) between the various components. In certain embodiments, the first adhesive is a low viscosity liquid adhesive to facilitate penetration of the adhesive into the small spaces along the joints, e.g., due to wicking action. Using a low viscosity adhesive may take advantage of this wicking action such that no adhesive need be applied before assembling the components, e.g., before mating the notch and tab structures. For example, the viscosity of this first adhesive may be not greater than about 250 centipoise at 20 rpm, such as not greater than about 200 centipoise at 20 rpm or even not greater than about 175 centipoise at 20 rpm. However, the viscosity of the first adhesive should not be so low that the liquid adhesive completely passes through the joints and leaks to the outside of the assembly. The first adhesive may be applied using pneumatic glue dispensing equipment, syringes and needles. During adhesive application, adhesive tape may be utilized to mechanically hold the loose pieces together prior to adhesive curing. After application of the first UV adhesive, the adhesive may be cured, such as in a UV curing oven. During curing, the interior of the compartmented assembly is disposed facing the UV source without masking such that the adhesive is exposed to the UV source. For example, the assembly may be placed on the belt of a UV curing conveyor oven with the interior facing upwardly and transported through the oven.

After this first curing step, a second UV curable adhesive may be applied to an interior portion of the joints. This second adhesive may have a higher viscosity than the first adhesive and may be applied, e.g., to all of the joints, particularly to the joints between the bottom panel floor and the divider panel bottom edge, e.g., to fill any voids along this joint. The second and any subsequent adhesives may be thicker adhesives (e.g., higher viscosity) with the same or very similar curing, clarity and temperature properties as the first adhesive. However, with this second adhesive, the strength of the adhesive is not as critical. The second adhesive is primarily used to fill voids, gaps, cracks and to smoothen out the appearance of the joint areas for aesthetic purposes. The second adhesive may also fill in any areas where the application of the first adhesive was incomplete. The viscosity of the second adhesive should be sufficient to prevent running and dripping when glued to a vertical joint (e.g., versus gravity), and should not be so thick that it forms a freestanding bead and does not flow down flat, but instead forms a slight fillet weld. The second adhesive may also be applied using pneumatic glue dispensing equipment, syringes and needles.

After the application of the second adhesive, the assembly may then be subjected to a second UV curing step to cure the second adhesives. After the second curing step, the masking and remaining assembly tape may be removed from the exterior portions of the assembly, and the assembly may be subjected to a third UV curing step, this time with the bottom/exterior portions of the assembly facing the UV source to complete the compartmented assembly.

In one embodiment of the method for constructing a compartmented assembly, the compartmented assembly, as a whole unit or in parts, may be destaticized, e.g., treated to reduce static electricity that may build up on the components. In one embodiment, the compartmented assembly may be passed through a neutral or balanced flow of ionized air. For example, the compartmented assembly may be disposed in front of an ionizing blower such as Dr. Schneider SL-001 Desktop Ionizing Blower. Preferably, a blower used in such an application would produce at least 10 cubic feet per minute (CFM) of ionized air, for example at least 45 CFM, such as at least 100 CFM. As the volume or richness of ionized air is increased, the length of time the compartmented assembly is disposed in the flow of ionized air may be reduced. In one example, the compartmented assembly may disposed in the flow of ionized air for at least 10 seconds. It may be desirable to destaticize the compartmented assembly before assembling the panels, immediately after assembling the panels, before a first application of adhesive, before applying each subsequent application of adhesive, after cleaning the completed compartmented assembly, and/or before packaging the assembly for shipment. The destaticizing may help reduce problems that can arise from the buildup of static electricity on the compartmented assembly. For example, static electricity may undesirably attract droplets of liquid adhesive to regions of the compartmented assembly where the adhesive is not required, potentially being detrimental to the aesthetic qualities of the compartmented assembly.

In another embodiment of this disclosure, a method for the manufacture of a compartmented assembly from customer specifications is provided. The method may include providing an interactive template over a network, such as the Internet, that enables a user to graphically design a compartmented assembly comprising a bottom panel and at least three side panels that define a primary compartment, and that includes at least one divider panel bisecting the primary compartment to form two sub-compartments. The interactive template may provide the user with the ability to graphically input specifications for the compartmented assembly. The specifications may include, for example, specifying the size and shape of the base panel and specifying the placement of the at least one divider panel within the primary compartment. Other specifications that may be input by the user include the size and shape of the divider panel, the height of the compartmented assembly, etc.

Figure 10:
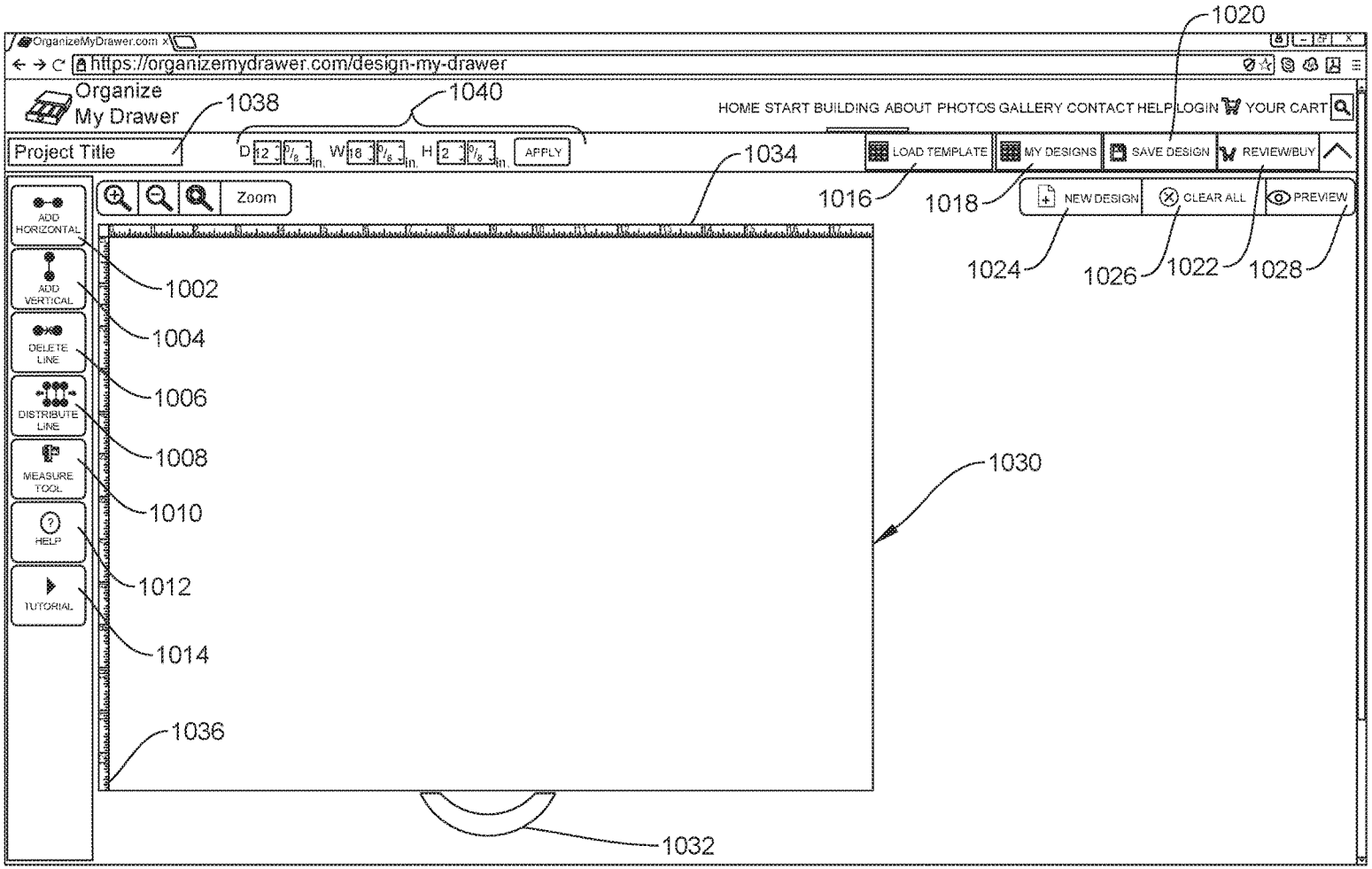
FIGS. 10-17 illustrate screenshots of an interactive user interface that enables a user to design a customized compartmented assembly.

FIG. 10 illustrates a screenshot (e.g., from a display operatively connected to or integral with a computerized device, such as a computer or a tablet) of an interface that enables a user to interactively design a customized compartmented assembly. Specifically, FIG. 10 illustrates the following interactive features that may be selected and/or manipulated by a user such as through a keyboard and/or a pointing device (e.g., a mouse) controlling a cursor:

- workspace 1030 is the area where the design of the compartmented assembly will be illustrated as a top view; workspace 1030 is framed by a solid rectangle outline representative of the four outer walls of the assembly; workspace 1030 includes a drawer handle 1032 and includes a horizontal ruler 1034 and a vertical ruler 1036;
- the Project Title input block 1038 may be filled in by the user to give a name to the custom design for the compartmented assembly;
- the Drawer Dimension input blocks 1040 may be used by the user to input the outer dimensions of the compartmented assembly that may be intended to fit inside a drawer, or other space;
- Add Horizontal button 1002 may be selected by the user to add a horizontal line (e.g., representing a divider wall) to the workspace 1030;
- Add Vertical button 1004 may be selected by the user to add a vertical line (e.g., representing a divider wall) to the workspace 1030;
- Delete button 1006 may be selected by the user to delete a line that is selected in the workspace 1030;
- Distribute Lines button 1008 may be selected by the user to evenly distribute two or more selected lines within the workspace 1030 having the same orientation (e.g., vertical or horizontal), e.g., between the outer walls of the workspace 1030;
- the Help button 1012 and the Tutorial button 1014 may be selected by the user to obtain assistance for using the graphical interface;
- the Load Template button 1016 may be selected by the user to load a previous design for a compartmented assembly into the workspace 1030
- once loaded, the user may manipulate the template using the buttons described above;
- the My Designs button 1018 may be selected by the user to retrieve previous designs that were created by the user and stored for later retrieval; in this regard, the Save Design button 1020 may be selected to save the current design—the saved design may optionally be shared with other users of the system;
- the New Design button 1024 may be selected by the user to begin a new design for a custom compartmented assembly;
- the Clear All button 1026 may be selected by the user to clear all lines from the workspace 1030, such as to begin a new design;
- the Preview button 1028 may be selected by the user to preview the design in the workspace 1030; and
- once a design is completed in the workspace 1030, the user may select the Review/Buy button 1022 to review the final design and purchase the customized compartmented assembly.

Figure 11:
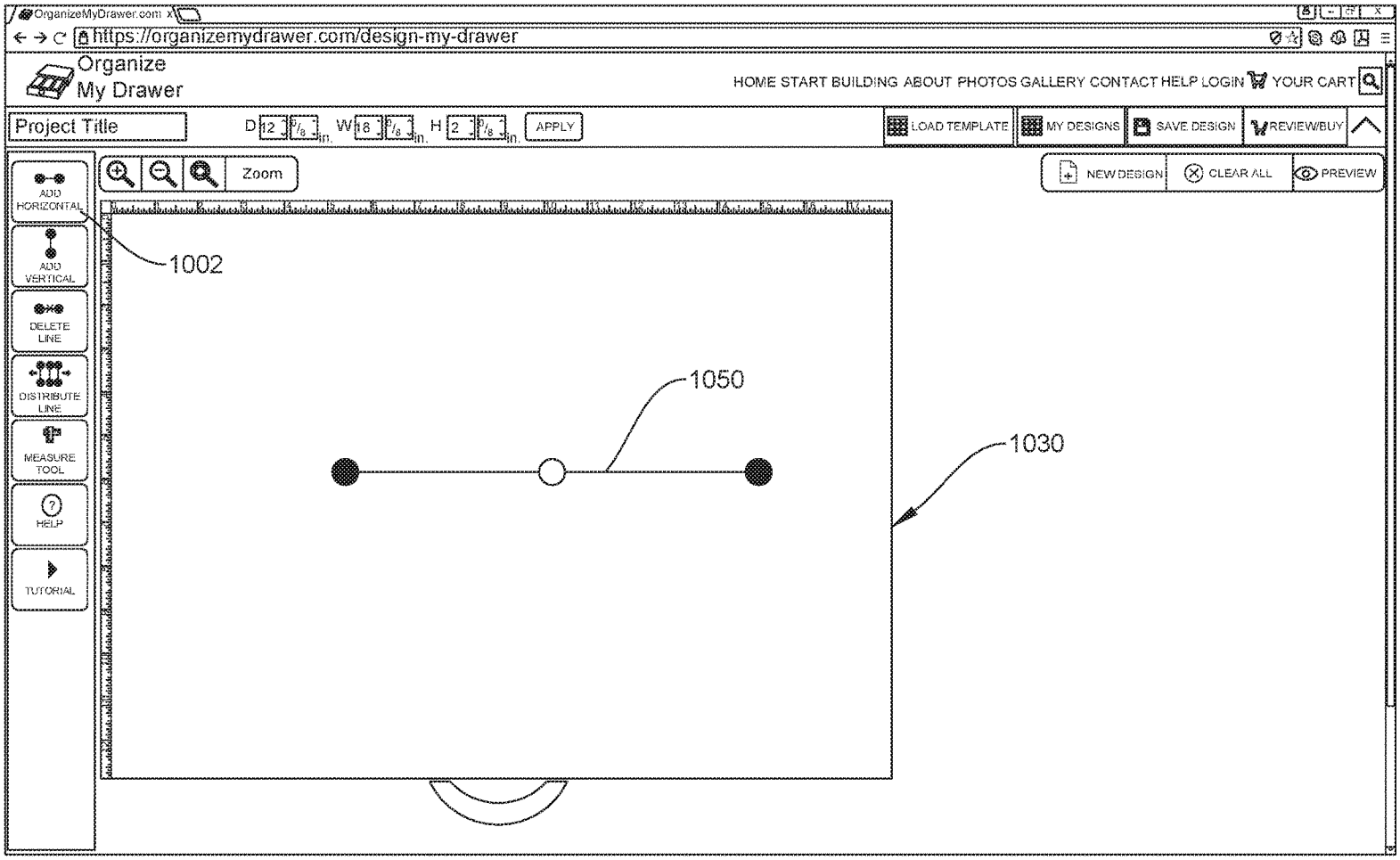
Figure 12:
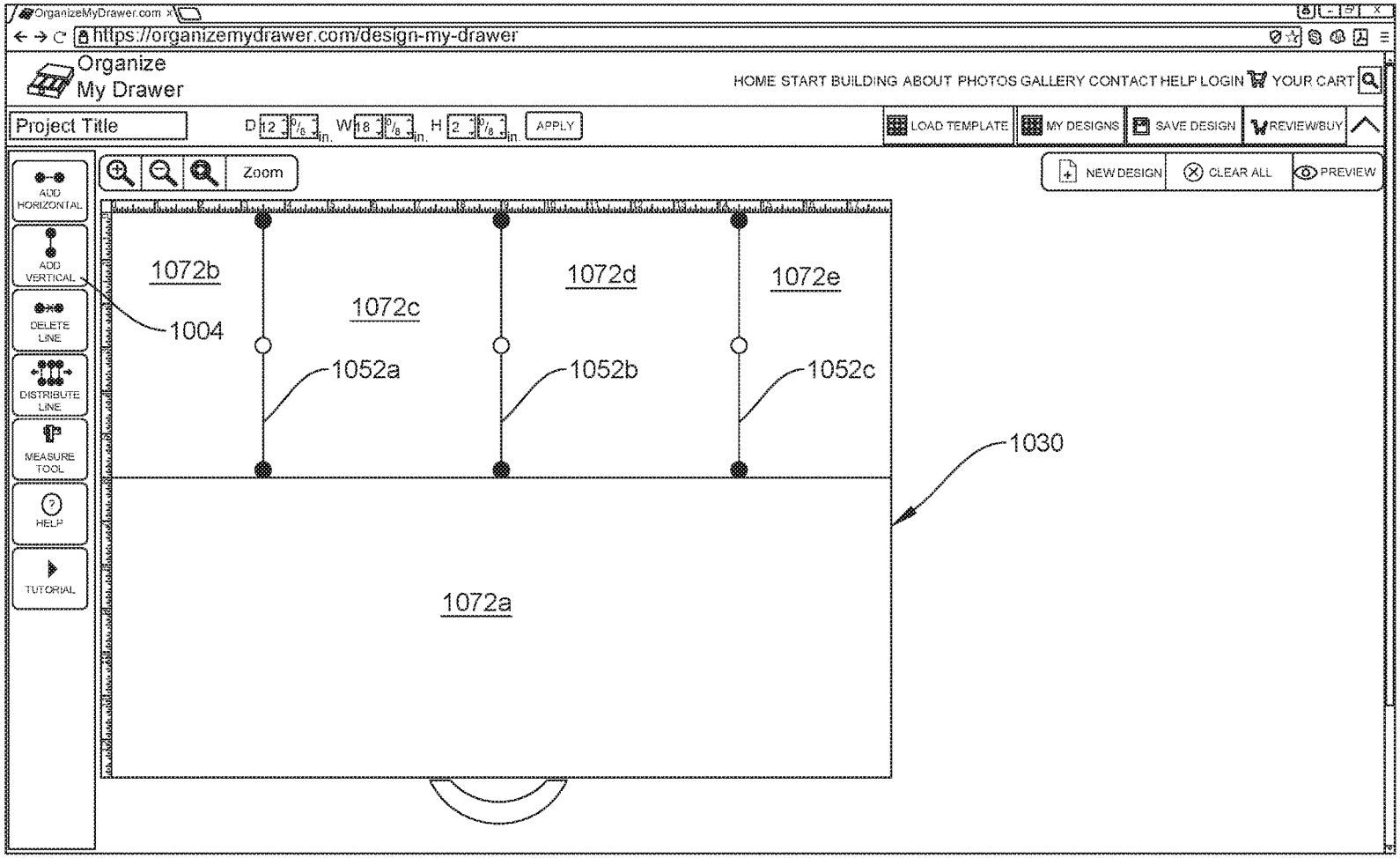

These features will be described in more detail below with respect to FIGS. 11-16. FIG. 11 illustrates the use of the Add Horizontal button 1002 to place a horizontal line 1050 within the workspace 1030 representing a divider panel. The horizontal line 1050 may then be manipulated, e.g., using a mouse and cursor, to change the length of the line 1050 and to move the line 1050 within the workspace 1030. As illustrated in FIG. 12, a single horizontal line 1050 has been created within the workspace 1030 to represent a divider panel extending the width of the compartmented assembly. As is also illustrated in FIG. 12, the selection of the Vertical Line button 1004 may be used in a similar fashion to place vertical lines 1052*a*/1052*b*/1052*c* within the workspace 1030. As with the horizontal line, the vertical lines 1052*a*/1052*b*/1052*c*, may be manipulated by changing the length and adjusting their placement within the workspace 1030.

FIG. 12 thus illustrates the placement of one horizontal lines 1050 as well as the three vertical lines 1052*a*/1052*b*/1052*c* within the compartmented assembly to represent four divider panels within a rectangular compartmented assembly. The divider panels form five sub-compartments 1072*a*/1072*b*/1072*c*/1072*d*/1072*e* within the compartmented assembly.

Figure 13:
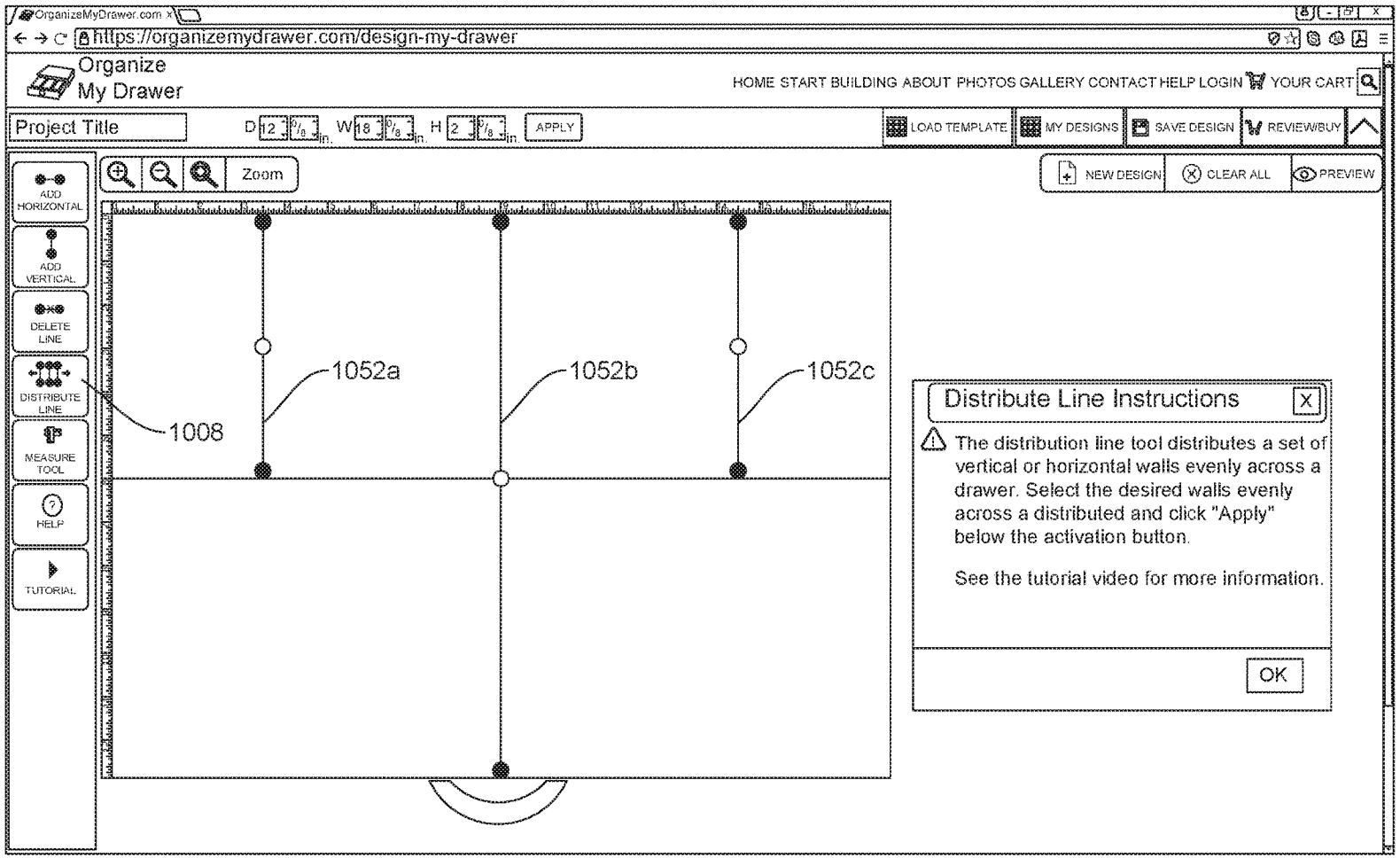
Figure 14:
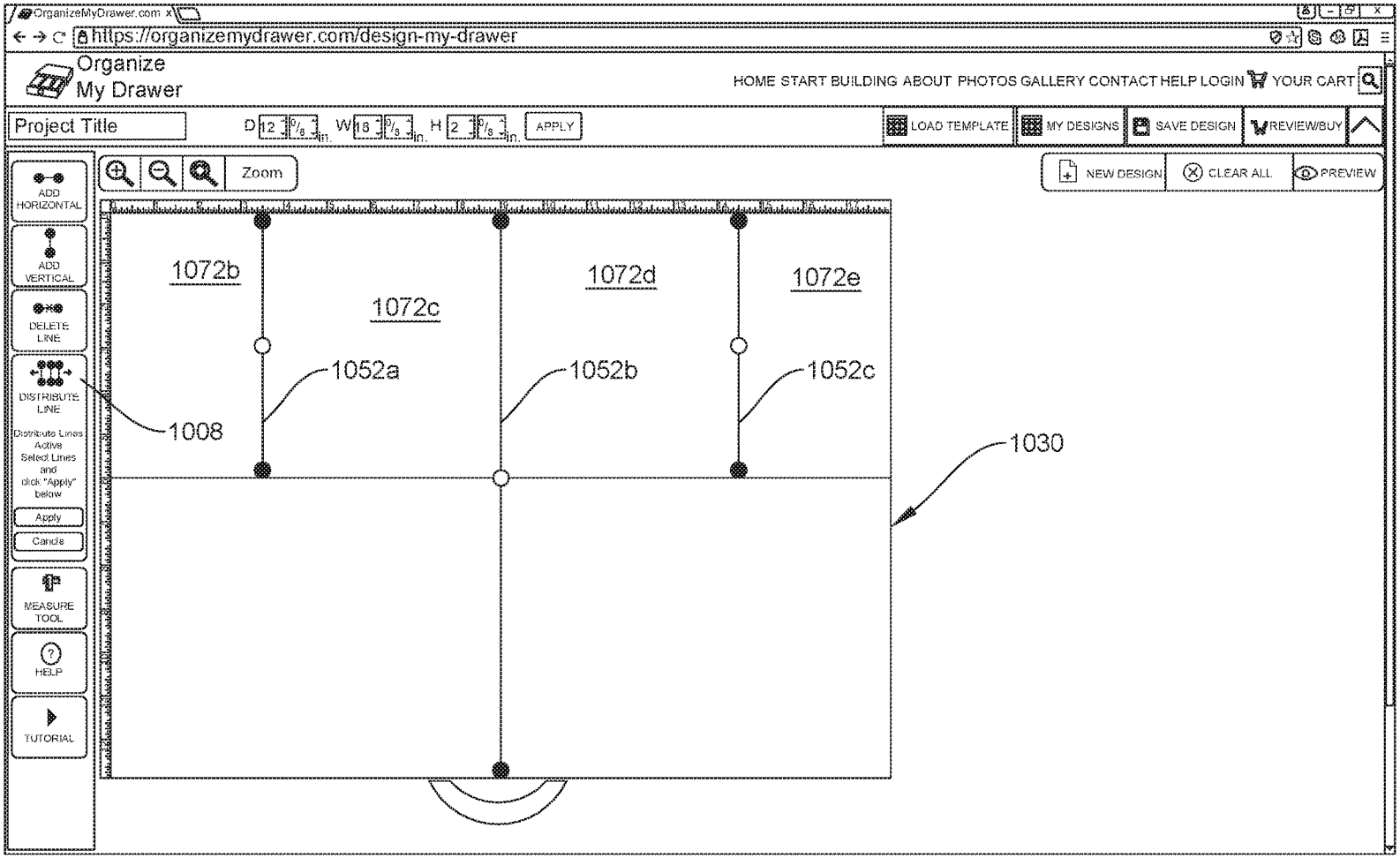

Of note, as illustrated in FIG. 12, the three vertical lines 1052*a*/1052*b*/1052*c* representing three divider panels are not evenly spaced, e.g., are not evenly spaced between the two vertical side panels of the compartmented assembly. Often, a user desires to have such lines be evenly spaced, e.g., to create sub-compartments having the same dimensions. To facilitate this design, the Distribute Lines button 1008 may be selected. As is illustrated in FIG. 13, the Distribute Lines button 1008 enables a user to evenly distribute a set of vertical or horizontal lines evenly across a portion of the compartmented assembly. Thus, the set of vertical lines 1052*a*/1052*b*/1052*c* may be selected and an Apply button (FIG. 14) that appears beneath the Distribute Lines button 1008 may be selected to evenly distribute the vertical lines 1052*a*/1052*b*/1052*c*. Thus, as is illustrated in FIG. 14, the vertical lines 1052*a*/1052*b*/1052*c* are automatically moved to create even spacing between the outer frame 1030, creating four sub-compartments 1072*b*/1072*c*/1072*d*/1072*e* having the same dimensions.

Figure 15:
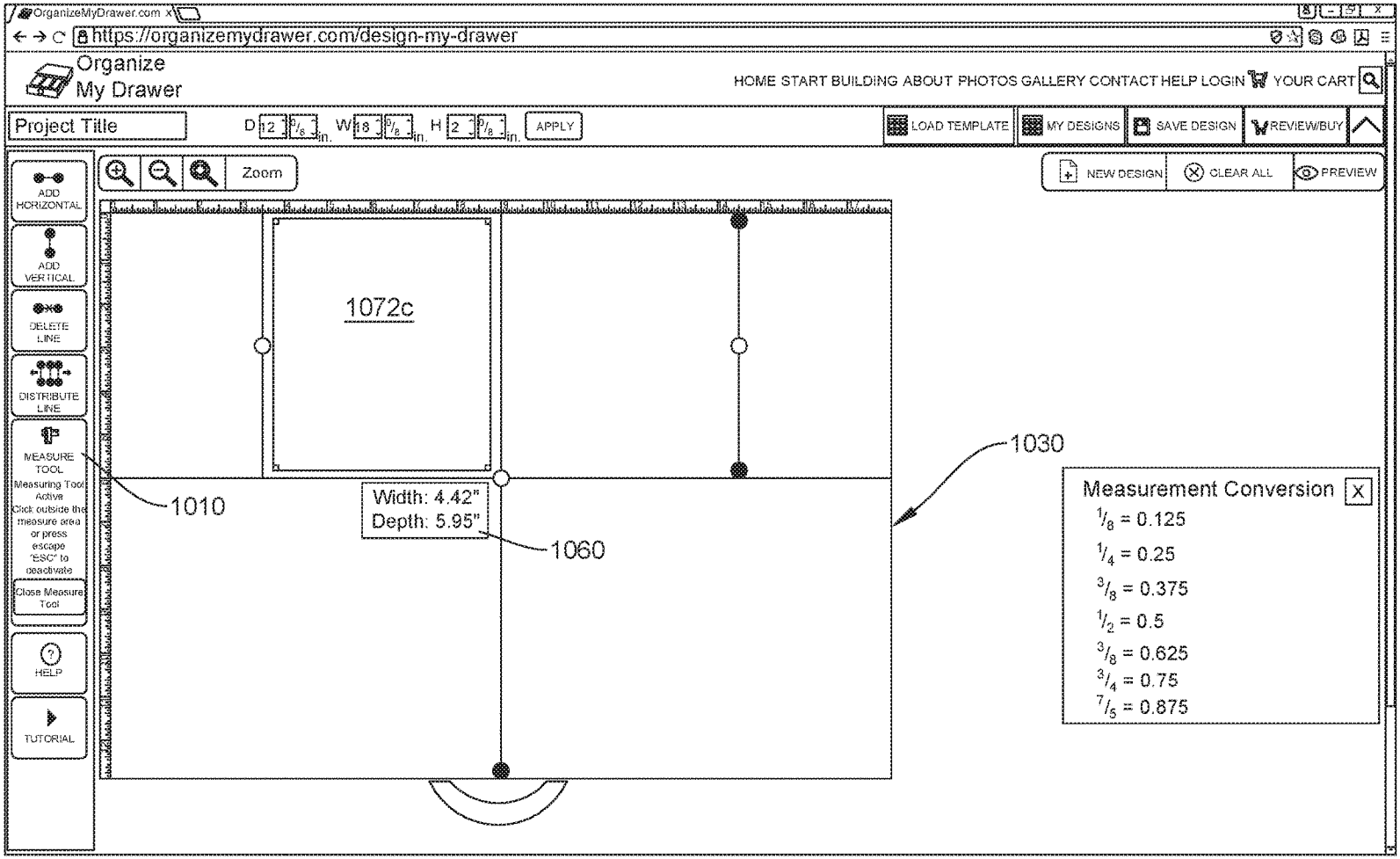

FIG. 15 illustrates the selection of the Measure Tool button 1010. Selection of this button enables a user to display the measurements (e.g., in inches) of a two-dimensional area within the workspace 1030. The measure tool rectangle may be stretched by dragging the corners and/or sides. This feature enables the user to see the exact dimensions 1060 of a particular area of the compartmented assembly. As illustrated in FIG. 15, the measure tool indicates the dimensions of the sub-compartment 1072*c*.

Figure 16:
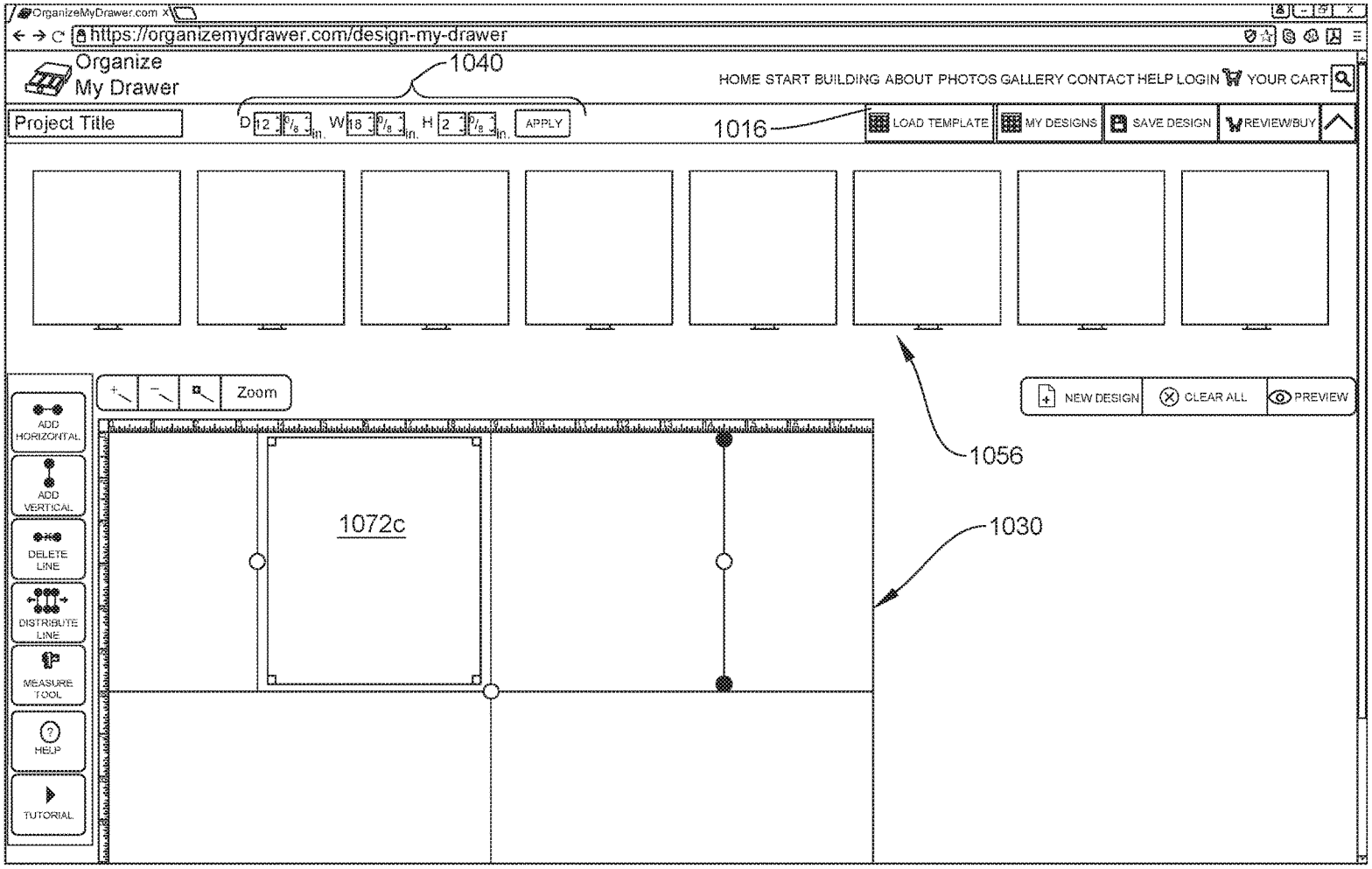

FIG. 16 illustrates the use of the show templates button 1016. When the show templates button 1016 is selected, one or more templates 1056 for different compartmented assembly designs appear above the workspace 1030. This advantageously enables a user to select one of the templates 1056 which will then be displayed in the workspace 1030. Thereafter, at the user's option, the user may further manipulate the components (e.g., represented by the horizontal and/or vertical lines) to create their own custom design from the template, or may simply resize the workspace (e.g., using the Drawer Dimension Inputs 1040) to fit the template within the desired size space.

Figure 17:
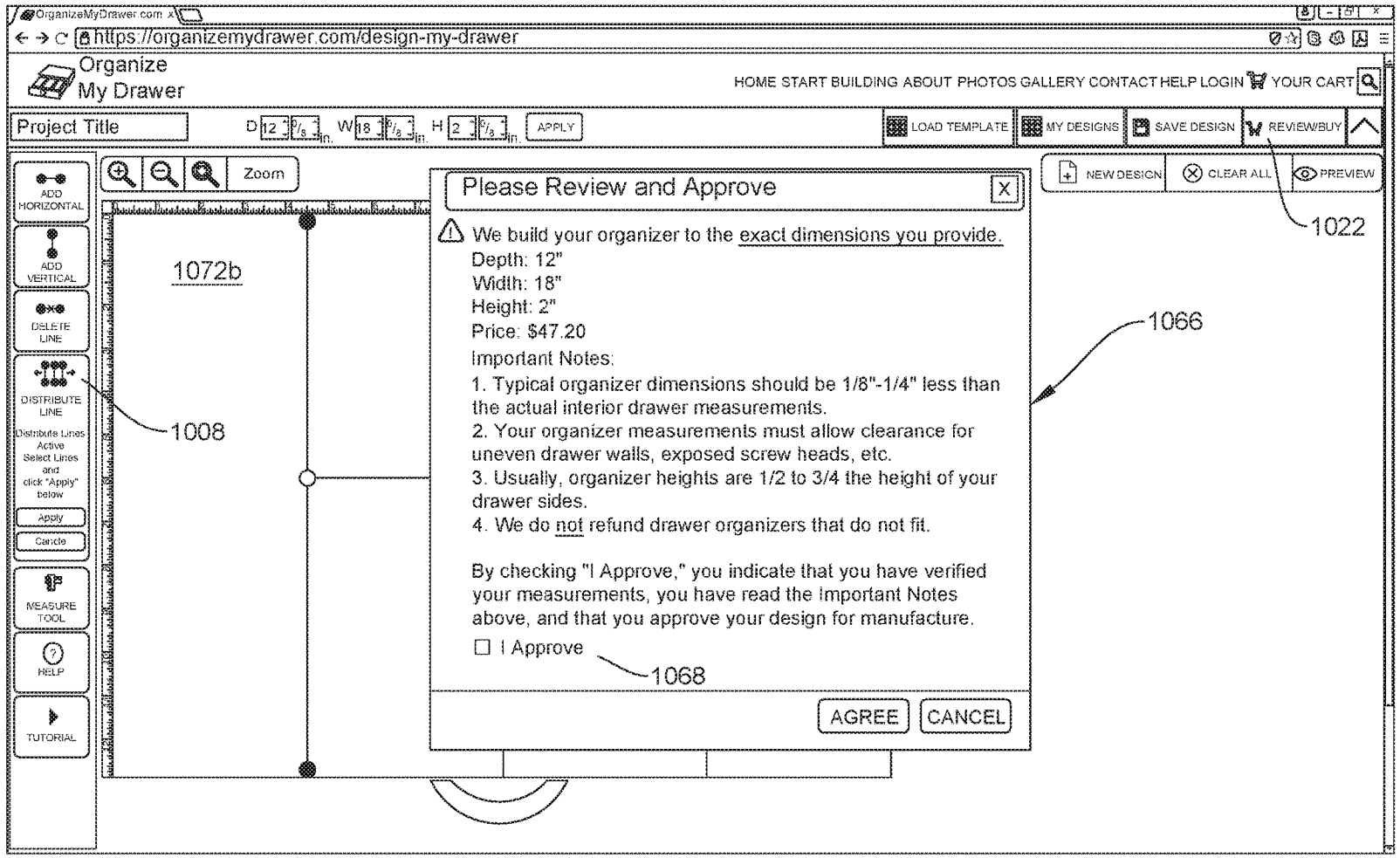

The custom design created by the user may be transmitted to the manufacturer, e.g., by selection of the review/buy button 1022 (FIG. 10). As is illustrated in FIG. 17, selection of this option brings up a text box 1066 displaying the outer dimensions for the compartmented assembly and the price. The price may be calculated by software using configurable formulas based on the design surface area, quantities of divider pieces, and total linear joint lengths. If the user agrees to the dimensions and price, the I Approve button 1068 may be selected. This action sends the specifications to the manufacturer over a network, e.g., over the internet or LAN. Software may be utilized to generate a production file, such as for implementation on a digitally-controlled laser cutting device, and may also generate a print-out that may be used to quality check the user's design with the final product. The print-out may include other information such as a price, design title, a stock keeping unit (SKU), design dimensions, quantity and an image of the design. The customized compartmented assembly may then be manufactured in a manner substantially as described above.

An illustration of a production file is illustrated in FIG. 18. More specifically, FIG. 18 illustrates that manner in which seven components of a compartmented assembly may be cut (e.g., laser cut) from a material sheet. As illustrated, the components include a bottom panel 102, four side panels 120*a*-120*d*, and two divider panels 150*a* and 150*b*. For cutting purposes, the various components are placed closely together by software using a two-dimensional bin-packing algorithm to reduce material sheet scrap. The components are substantially similar to the components illustrated in FIGS. 3-8, with the exception of a single aperture (e.g., apertures 130*c*, 130*d* and 130*e*) on the side walls and a single aperture 168*a* on the divider panel 150*a*. Similarly, the side panels and divider panels include a single end edge tab or a single end edge notch, i.e., as compared to the plurality of tabs and notches illustrated in FIGS. 3-8. This illustrates that the side edges of the components may not require a plurality of tabs and notches to have sufficient strength and integrity when assembled, particularly when the compartmented assembly is relatively low in height (e.g., shallow). It should also be noted that a single tab/notch may also be used in one or more of the bottom edges and corresponding edge of the base panel, particularly when the compartmented assembly is relatively narrow (e.g., has at least one side dimension that is relatively small).

FIG. 19 illustrates an embodiment of a compartmented assembly 200 wherein two divider panels 250*a* and 250*b* intersect (e.g., a cross-joint). For purposes of this illustration, notches/tabs on the bottom and end edges of the divider panels are not shown. In this embodiment, the cross-joint 282 may be formed by cutting a channel 280*a*/280*b* partly along the height of each divider panel. During assembly, the two channels may be mated and may be adhered together substantially as described above.

EXAMPLES

A solid sheet of cast acrylic having a size of 25 inches by 40 inches is obtained from Piedmont Plastics Company, Littleton, Colo. The cast acrylic is Plexiglas G, fabricated by the Arkema Group (King of Prussia, Pa.). This cast acrylic sheet material is selected due to its clarity, strength and flexibility, as well as its resistance to crazing and cracking when exposed to chemicals such as isopropyl alcohol that may be used for cleaning the adhesive from the assembled compartmented assembly. This material also withstands cold temperatures well so that it can be used in a freezer or refrigerator, or outdoors.

The cast acrylic sheet has a nominal thickness of ~⅛ inch (0.118 inch). The cast acrylic sheet has paper masking covering both sides of the sheet. The acrylic sheet is placed in a laser machining apparatus. Implementing digital instructions, the laser machining apparatus cuts the following pieces from the cast acrylic sheet:

1) a rectangular bottom panel to outer dimensions of 3 inches by 4 inches, with seven evenly spaced notches cut into each of the 4 inch long bottom panel edge portions and five evenly spaced notches cut into each of the 3-inch shorter bottom panel edge portions;
2) five (5) evenly spaced divider panel attachment tab apertures into the bottom panel, the five (5) evenly spaced divider panel attachment tab apertures extending linearly from the first 4-inch long bottom panel edge portion to the opposite 4-inch long bottom panel edge portion and forming a first row of apertures, at a distance of about 1.5 inches from the first 3-inch shorter bottom panel edge portion and disposed substantially parallel thereto;

3) another five (5) evenly spaced divider panel attachment tab apertures into the bottom panel, the five (5) evenly spaced divider panel attachment tab apertures extending linearly from a first 3-inch long bottom panel edge portion to the first row of apertures, at a distance of about 1.5 inches from a 4-inch bottom panel edge portion and substantially parallel thereto;

4) two rectangular side panels to outer dimensions of 4 inches by 1 inch, with eight evenly spaced notches cut into the 4-inch bottom edge of each side panel and four evenly spaced notches cut into the 1-inch side edges of each side panel;

5) three (3) evenly spaced divider panel attachment tab apertures into each of the side panels, the three (3) evenly spaced divider panel attachment tab apertures extending linearly from the bottom edge of the side panel to the top edge of the side panel, at a distance of about 1.5 inches from a side edge of the side panel and substantially parallel thereto;

6) two rectangular side panels to outer dimensions of 3 inches by 1 inch, with six evenly spaced notches cut into the 3-inch bottom edge of each side panel and four evenly spaced notches cut into the 1-inch side edges of each side panel;

7) three (3) evenly spaced divider panel attachment tab apertures into one of the 3 inches by 1 inch side panels, the three (3) evenly spaced divider panel attachment tab apertures extending linearly from the bottom edge of the side panel to the tope edge of the side panel, at a distance of about 1.5 inches from a side edge of the side panel and substantially parallel thereto;

8) a first divider panel to outer dimensions of 3 inches by 1 inch, with six evenly spaced notches cut into the 3-inch bottom edge of the first divider panel and four evenly spaced notches cut into the 1-inch side edges of the first divider panel;

9) three (3) evenly spaced divider panel attachment tab apertures into the first divider panel, the three (3) evenly spaced divider panel attachment tab apertures extending linearly from the bottom edge of the first divider panel to the top edge of the first divider panel, at a distance of about 1.5 inches from a side edge of the first divider panel and substantially parallel thereto;

10) a second divider panel to outer dimensions of 2.5 inches by 1 inch, with six evenly spaced notches cut into the 2.5-inch bottom edge of the second divider panel and four evenly spaced notches cut into the 1-inch side edges of the second divider panel.

After cutting of the components, the paper masking is removed from all sides of the components that will form interior faces (e.g., within the primary compartment). The removal of the paper masking is facilitated by warming the components slightly to soften the adhesive layer of the masking. The various components are then assembled into the desired configuration by mating the tabs and notches and gently taping the components to temporarily hold them together using high-temperature tolerant masking tape (e.g., tape that does not leave adhesive residue after being exposed to heat/UV radiation). DYMAX Ultra Light-Weld 3099 UV curable adhesive is then applied to the interior joints and wicks into the joints due to the relatively low viscosity of this adhesive (about 150 centipoise at 20 rpm) using pneumatic dispensing machine with syringes and needles selected to accurately control the adhesive flow. The assembly is then passed through a UV curing oven (DYMAX 25" WIDECURE UV Light Curing Conveyor, Model: 39381) with the non-masked sides facing toward the UV source (e.g., facing upwards).

Thereafter, any assembly tape used on the non-masked sides is removed and a second application of a higher viscosity adhesive (DYMAX Ultra Light-Weld 3069, having a viscosity of about 450 centipoise at 20 rpm) is made to the interior joints, and to fill voids on the joints between the interior dividers and the bottom panel, using pneumatic dispensing machine with syringes and needles selected to accurately control the adhesive flow. The assembly is then exposed again to UV radiation in the UV curing oven with the non-masked sides facing toward the UV source. Thereafter, the remaining paper masking and assembly tape is removed from the assembly and the assembly is inverted and again passed through the UV curing oven with the previously masked surfaces (e.g., the bottom surface and/or side surfaces) facing the UV source.

Figure 9:
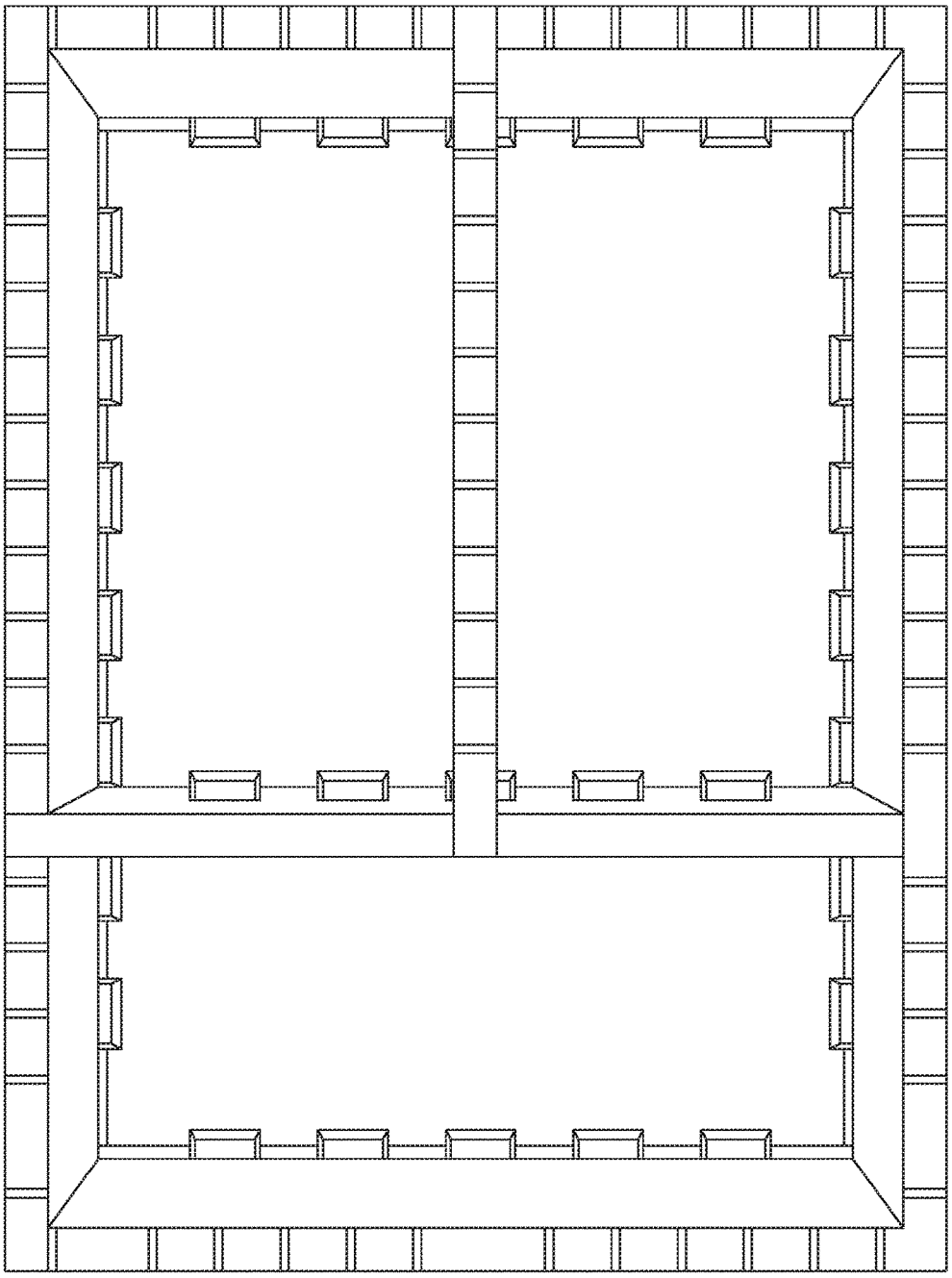
FIG. 9 is a photo illustration of a compartmented assembly according to an embodiment of this disclosure.

After the third curing step the compartmented assembly may be cleaned (e.g., with a solvent and plastics cleaner/polisher) to remove any undesirable contamination from the surfaces of the assembly. A top view photo illustration of this compartmented assembly is illustrated in FIG. 9.

While various embodiments and aspects have been described in detail, it is apparent that modifications and adaptations of those embodiments and aspects will occur to those skilled in the art. However, it is to be expressly understood that such modifications and adaptations are within the spirit and scope of the present disclosure. Moreover, the embodiments and aspects described herein are not mutually exclusive. Each embodiment and aspect may combined with any number of others.

What is claimed is:

1. A compartmented assembly, comprising:

a bottom panel comprising a bottom panel floor bounded by at least three bottom panel edges, the bottom panel edges comprising a plurality of bottom panel edge attachment notches disposed along each of the bottom panel edges, the bottom panel edge attachment notches defining bottom panel edge attachment tabs therebetween;

at least three side panels, each of the at least three side panels comprising a side panel wall bounded by a side panel top edge, a side panel bottom edge and two side panel end edges, wherein each side panel bottom edge comprises side panel bottom edge attachment notches defining side panel bottom edge attachment tabs therebetween, and at least two of the side panels comprising at least a first side panel wall attachment aperture disposed in the side panel wall of the at least two side panels; and at least a first divider panel comprising a divider panel wall bounded by a divider panel top edge, a divider panel bottom edge and two divider panel side edges, wherein the divider panel bottom edge comprises divider panel bottom edge attachment notches defining at least one divider panel bottom edge attachment tab therebetween, and wherein the divider panel side edges comprise at least two divider panel side edge attachment notches defining at least one divider panel side edge attachment tab therebetween;

wherein the at least three side panels are attached to the bottom panel by mating the side panel bottom edge attachment tabs to the bottom panel edge attachment notches, such that the at least three side panels are disposed substantially orthogonally from the bottom panel floor to define a primary compartment bounded by the bottom panel floor and the at least three side panel walls, wherein the at least first divider panel is attached to the assembly by mating the at least one divider panel side edge attachment tab to the first side panel wall attachment aperture, wherein the divider panel divides the primary compartment into at least first and second sub-compartments, and wherein at least one of the side panels and the divider panel(s) are secured to the bottom panel using an adhesive.

2. The compartmented assembly recited in claim 1, wherein the bottom panel comprises at least a fourth bottom panel edge and the compartmented assembly comprises at least a fourth side panel that is attached to the bottom panel by mating a fourth side panel bottom edge attachment tab to a bottom panel edge attachment notches such that the at least four side panels are disposed substantially orthogonally from the bottom panel to define a primary compartment bounded by the bottom panel and the at least four side panels.

3. The compartmented assembly recited in claim 2, wherein the at least four side panels define a substantially rectangular primary compartment.

4. The compartmented assembly recited in claim 1, wherein the bottom panel floor comprises at least a first bottom panel floor attachment aperture disposed in the bottom panel floor.

5. The compartmented assembly recited in claim 4, wherein the bottom panel floor comprises a plurality of the bottom panel floor attachment apertures disposed in a substantially linear arrangement in the bottom panel floor.

6. The compartmented assembly recited in claim 5, wherein the compartmented assembly comprises at least a second divider panel that divides the sub-compartment into at least two smaller sub-compartments.

7. The compartmented assembly recited in claim 6, wherein the bottom panel floor comprises at least a second plurality of bottom panel floor attachment apertures disposed in a substantially linear arrangement in the bottom panel floor, and wherein the second divider panel is attached to the bottom panel by mating second divider panel bottom edge attachment tabs to the second plurality of divider panel bottom panel floor attachment apertures disposed in the bottom panel floor to divide the sub-compartment into at least two smaller sub-compartments.

8. The compartmented assembly recited in claim 7, wherein the second divider panel is disposed substantially parallel to the first divider panel.

9. The compartmented assembly recited in claim 7, wherein the second divider compartment is disposed substantially orthogonal to the first divider panel.

10. The compartmented assembly recited in claim 7, wherein the side panel end edges comprise at least one side panel end edge attachment tab or at least one side panel end edge attachment notch that is mated to a corresponding side panel end edge attachment tab or side panel end edge attachment notch that is disposed in an adjacent side panel.

11. The compartmented assembly recited in claim 1, wherein the bottom panel, side panels and divider panel(s) are fabricated from acrylic.

12. The compartmented assembly recited in claim 11, wherein the acrylic is cast acrylic.

13. The compartmented assembly recited in claim 1, wherein the bottom panel, side panels and divider panel(s) have a thickness of at least about 0.106 inches.

14. The compartmented assembly recited in claim 13, wherein the bottom panel, side panels and divider panel(s) have a thickness of not greater than about 0.275 inches.

15. The compartmented assembly recited in claim 1, wherein each of the side panels and the divider panel(s) are secured to the bottom panel using an adhesive.

16. The compartmented assembly recited in claim 1, wherein the adhesive is a radiation curable adhesive.

17. The compartmented assembly recited in claim 16, wherein the adhesive is a UV curable adhesive.

18. The compartmented assembly recited in claim 1, wherein the adhesive is a clear acrylic adhesive.

19. The compartmented assembly recited in claim 1, wherein the adhesive is an acrylated urethane adhesive.

20. The compartmented assembly recited in claim 1, wherein the portions of the bottom panel floor that are circumscribed by the side panels and divider panel(s) are free of bottom panel floor attachment apertures.

* * * * *